US009662768B2

(12) United States Patent
Sharmila et al.

(10) Patent No.: US 9,662,768 B2
(45) Date of Patent: May 30, 2017

(54) COATED ABRASIVE ARTICLE INCLUDING A NON-WOVEN MATERIAL

(71) Applicants: Saint-Gobain Abrasives, Inc., Worcester, MA (US); Saint-Gobain Abrasifs, Conflans-Sainte-Honorine (FR)

(72) Inventors: Muthukrishnan Sharmila, Chennai (IN); Adiseshaiah K. Sathyanarayanaiah, Chennai (IN); Srirangapattana Narasimhaiah Srihari, Bangalore (IN); Sérgio Andrade De Melo, Guarulhos (BR); André Volpiani, São Paulo (BR)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 132 days.

(21) Appl. No.: 14/562,144

(22) Filed: Dec. 5, 2014

(65) Prior Publication Data

US 2015/0158148 A1 Jun. 11, 2015

(30) Foreign Application Priority Data

Dec. 6, 2013 (IN) ..... 5628/CHE/2013

(51) Int. Cl.
*B24D 11/02* (2006.01)
*B24D 11/00* (2006.01)
(Continued)

(52) U.S. Cl.
CPC ..... *B24D 11/02* (2013.01); *B24D 3/004* (2013.01); *B24D 3/32* (2013.01); *B24D 11/005* (2013.01)

(58) Field of Classification Search
CPC ..... B24D 3/001; B24D 3/002; B24D 3/004; B24D 3/02; B24D 3/26; B24D 3/28;
(Continued)

(56) References Cited

U.S. PATENT DOCUMENTS 2,981,615 A 4/1961 Baumgartner et al.
4,011,063 A 3/1977 Johnston
(Continued)

FOREIGN PATENT DOCUMENTS

BR PI0503455 A 4/2007
CN 202825592 3/2013
(Continued)

OTHER PUBLICATIONS

International Search Report from PCT/US2014/068863, dated Apr. 6, 2015, 1 pg.

*Primary Examiner* — Timothy V Eley
(74) *Attorney, Agent, or Firm* — Abel Law Group, LLP; Joseph P. Sullivan

(57) ABSTRACT

A coated abrasive article including a body having a backing including a spunlace polyester-based material and a saturant contained in the spunlace polyester-based material, the saturant including a material selected from the group of phenolic resin, acrylic, urea resin, and a combination thereof, and an abrasive layer overlying the backing including abrasive particles.

19 Claims, 4 Drawing Sheets

(51) Int. Cl.
*B24D 3/32* (2006.01)
*B24D 3/00* (2006.01)

(58) Field of Classification Search
CPC ..... B24D 3/32; B24D 11/02; B24D 11/005; B24D 18/0036
See application file for complete search history.

(56) References Cited

U.S. PATENT DOCUMENTS 4,988,554 A 1/1991 Peterson et al.
5,026,591 A 6/1991 Henn et al.
5,078,753 A 1/1992 Broberg et al.
5,094,670 A 3/1992 Imada
5,203,884 A 4/1993 Buchanan et al.
5,482,756 A 1/1996 Berger et al.
5,549,719 A 8/1996 Lee et al.
5,565,011 A 10/1996 Follett et al.
5,578,098 A 11/1996 Gagliardi et al.
5,582,625 A 12/1996 Wright et al.
5,595,578 A 1/1997 Stubbs et al.
5,820,450 A 10/1998 Calhoun
5,902,360 A 5/1999 Linzell
6,406,576 B1 * 6/2002 Benedict ..... B24D 3/20 156/137
6,638,601 B1 10/2003 Follensbee
6,709,738 B2 * 3/2004 Ma ..... B24D 3/28 428/102
6,776,868 B2 8/2004 Follensbee
6,833,014 B2 12/2004 Welygan et al.
7,344,574 B2 * 3/2008 Thurber ..... B24D 11/001 451/28
7,344,575 B2 * 3/2008 Thurber ..... B24D 3/28 451/28
7,393,371 B2 7/2008 O'Gary et al.
7,393,391 B2 7/2008 Lopez et al.
8,470,061 B2 6/2013 Goldsmith et al.
2003/0213182 A1 11/2003 Knapp et al.
2004/0098923 A1 * 5/2004 Hood ..... B24D 3/348 51/296
2005/0081455 A1 4/2005 Welygan et al.
2007/0066197 A1 3/2007 Woo et al.
2007/0287366 A1 12/2007 Sanders et al.
2008/0172951 A1 7/2008 Starling
2009/0325466 A1 12/2009 Kincaid et al.
2010/0159805 A1 6/2010 Goldsmith et al.
2013/0130600 A1 * 5/2013 Carrozzella ..... B24B 1/00 451/59
2015/0174736 A1 * 6/2015 Sathyanarayanaiah B24D 11/02 51/298
2015/0306739 A1 * 10/2015 Vervacke ..... B05D 3/007 442/60
2016/0052106 A1 * 2/2016 Woo ..... B24D 11/001 451/532

FOREIGN PATENT DOCUMENTS

EP 0451944 B1 10/1991
EP 0724502 B1 8/1996
GB 957331 5/1964
WO 99/23291 5/1999
WO 2012082396 A1 6/2012

* cited by examiner

COATED ABRASIVE ARTICLE INCLUDING A NON-WOVEN MATERIAL

CROSS-REFERENCE TO RELATED APPLICATION

The application claims priority under 35 U.S.C. §119(a) to, and incorporates herein by reference in its entirety for all purposes, Indian application 5628/CHE/2013, filed Dec. 6, 2013, entitled "Coated Abrasive Article Including a Non-Woven Material", to Sharmila MUTHUKRISHNAN et al., which application is incorporated by reference herein in its entirety.

FIELD OF THE INVENTION

The present invention is generally directed to coated abrasive articles, and more particularly, a coated abrasive article including a non-woven material.

BACKGROUND

Abrasive articles, such as fixed, coated and bonded abrasive articles, are used in various industries to abrade work pieces by hand or by machine processes, such as by lapping, grinding, or polishing. Machining utilizing abrasive articles spans a wide industrial and consumer scope from optics industries, automotive paint repair industries, and metal fabrication industries to construction and carpentry. Machining, whether using complex automated systems or by hand with commonly available tools, such as with orbital polishers (both random and fixed axis), and belt and vibratory sanders, is performed to remove surface material in an amount, and in a manner, that achieves desirable surface characteristics.

Surface characteristics can include, among others, shine, texture, gloss, surface roughness, and uniformity. In particular, surface characteristics, such as roughness, gloss, and lack of surface imperfections are measured to determine quality. For example, when coating or painting a surface certain imperfections or surface defects can occur during the coating application or coating curing process. Such surface imperfections or surface defects might include pock marks, "orange peel" texture, "fish eyes", encapsulated bubbles, and dust defects, a.k.a., "dust nibs." Typically, such defects in a painted surface are removed by first sanding with a coarse grain abrasive, followed by subsequently sanding with progressively finer grain abrasives, and even buffing with wool or foam pads until a desired smoothness is achieved. Hence, the properties of an abrasive article used will generally influence the surface quality.

In addition to surface characteristics, industries are sensitive to cost related to abrasive operations. Factors influencing operational costs include the speed at which a surface can be prepared and the cost of the materials used to prepare that surface. Typically, the industry seeks cost effective materials having high material removal rates.

However, abrasives that exhibit high removal rates often exhibit poor performance in achieving desirable surface characteristics. Conversely, abrasives that produce desirable surface characteristics often have low material removal rates. For this reason, preparation of a surface is often a multi-step process using various grades of abrasive sheets. Typically, surface flaws (e.g., scratches) introduced by one step are repaired (e.g., removed) using progressively finer grain abrasives in one or more subsequent steps. Therefore, abrasives that introduce scratches and surface flaws result in increased time, effort, and expenditure of materials in subsequent processing steps and an overall increase in total processing costs.

An additional factor affecting material removal rate and surface quality is the "loading" of the abrasive with "swarf", i.e., the material that is abraded from the workpiece surface, which tends to accumulate on the surface of, and between, the abrasive particles. Loading is undesirable because it typically reduces the effectiveness of the abrasive product and can also negatively affect surface characteristics by increasing the likelihood of scratching defects.

The surface characteristics and material removal rate can also be affected by the durability of the abrasive article. Abrasive articles that wear easily or lose grains can exhibit both a low material removal rate and can cause surface defects. Quick wear on the abrasive article can lead to a reduction in material removal rate, resulting in frequent exchanging of the abrasive article and increased waste associated with discarded abrasive articles.

There continues to be a demand for improved abrasive articles.

BRIEF DESCRIPTION OF THE DRAWINGS

The present invention can be better understood, and its numerous features and advantages made apparent to those skilled in the art by referencing the accompanying drawings.

The use of the same reference symbols in different drawings indicates similar or identical items.

BRIEF DESCRIPTION OF THE EMBODIMENTS

Figure 1:
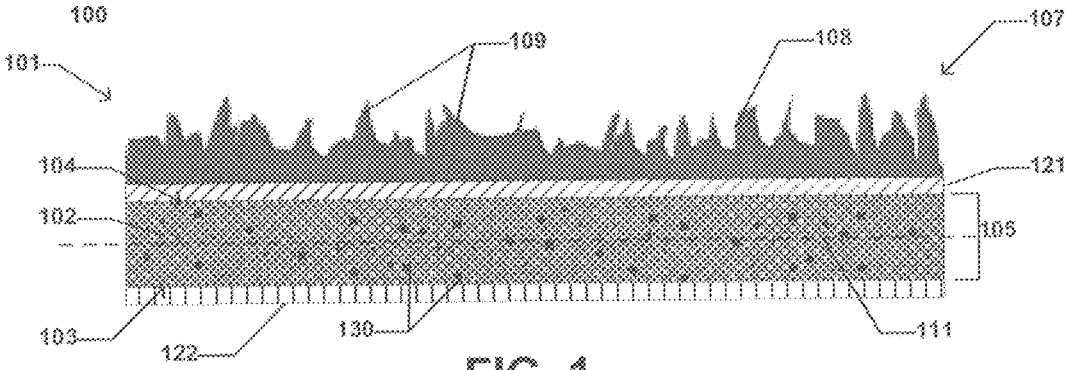
FIG. 1 includes a cross-sectional illustration of a portion of a coated abrasive article in accordance with an embodiment.

A coated abrasive article comprising a body including a backing including a spunlace polyester-based material and a saturant contained in the spunlace polyester-based material, wherein the saturant comprises a material selected from the group comprising of phenolic resin, acrylic, urea resin, and a combination thereof, and an abrasive layer overlying the backing including abrasive particles.

In another aspect, a coated abrasive article includes a body including a backing including a spunlace polyester-based material and a saturant contained in the spunlace polyester-based material, wherein the spunlace polyester-based material comprises an areal density of at least about 50 grams per square meter (GSM) and not greater than about 300 grams per square meter (GSM), and an abrasive layer overlying the backing including abrasive particles.

For another aspect, a coated abrasive article includes a body including a backing including a non-woven material having a machine-direction stiffness of at least about 80 MPa and not greater than about 220 MPa, and a cross-direction stiffness of at least about at least about 1 MPa and not greater than about 40 MPa, wherein the backing further comprises a saturant contained within the non-woven material, and an abrasive layer overlying the backing including abrasive particles.

In yet another aspect, a method of forming a coated abrasive article includes saturating a backing preform comprising a spunlace polyester-based material with a saturant to form a backing, wherein the saturant comprises a material selected from the group comprising of phenolic resin, acrylic, and a combination thereof, and forming an abrasive layer overlying the backing.

DETAILED DESCRIPTION OF THE EMBODIMENTS

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "average," when referring to a value, is intended to mean an average, a geometric mean, or a median value.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting.

The following is generally directed to abrasive articles, and more particularly, coated abrasive articles, including a body having a backing, and abrasive layer overlying the backing. In particular instances, the abrasive layer can include a single layer of abrasive material, such as abrasive particles contained within one or more layers of adhesive material. Coated abrasive articles may be suitable for use in material removal operations in various industries, including but not limited to, automotive, woodworking, building and structural industries, finishing of advanced materials, and the like.

FIG. 1 includes a cross-sectional illustration of a coated abrasive article in accordance with an embodiment. As illustrated, the coated abrasive article 100 can include a body 101. The body 101 can include a backing 102, including an upper major surface 104, and a lower major surface 103 opposite the upper major surface 104. Moreover, the body 101 can include an abrasive layer 107 overlying the backing 102, and more particularly, overlying an upper major surface 104 of the backing 102. The abrasive layer 107 can include abrasive particles 109, and at least one adhesive layer 108 configured to couple and bond the abrasive particles 109 to the backing 102.

In accordance with an embodiment, the backing 102 can include a non-woven material. Notably, the non-woven material may be a spunlace material, which is a material formed through a hydroentanglement process. For at least one embodiment, the backing 102 can include a non-woven material including a spunlace polyester-based material. In accordance with an embodiment, the spunlace polyester-based material of the backing 102 can include a majority content of polyester by volume. For example, the spunlace polyester-based material can include at least about 51 vol % polyester for the total volume of the backing 102, and more particularly, for the total volume of the non-woven material. In more particular instances, the spunlace polyester-based material can include at least 75 vol % polyester for the total volume of the spunlace polyester-based material. For example, the spunlace polyester-based material may be a composite including polyester, and another polymer or inorganic material, wherein at least 75 vol % of the composite spunlace material is polyester. In yet another embodiment, the spunlace polyester-based material can consist essentially of polyester, and more particularly, can consist essentially of spunlace polyester.

According to an embodiment, the non-woven material of the backing (e.g., the spunlace polyester-based material) can have a particular areal density that may facilitate the formation of a coated abrasive article having the features of the embodiments herein. For example, the non-woven material, such as the spunlace polyester-base material of the backing 102 can have an areal density of at least 50 grams per square meter (i.e., $g/m^2$ or GSM). In another embodiment, the non-woven material, such as the spunlace polyester-based material of the backing 102 can have an areal density of at least about 60 GSM, such as at least about 70 GSM, at least about 80 GSM, at least about 90 GSM, at least about 100, GSM, at least about 110 GSM, at least about 120 GSM, at least about 130 GSM, at least about 140 GSM, or even at least about 150 GSM. Still, and another embodiment, the non-woven material, such as the spunlace polyester-based material, of the backing 102 can have an areal density of not greater than about 300 GSM, such as, not greater than about 290 GSM, such not greater than about 280 GSM, not greater than about 270 GSM, not greater than about 260 GSM, or even not greater than about 250 GSM. It will be appreciated that the non-woven material of the backing 102, such as the spunlace polyester-based material, can have an real density within a range between any of the minimum and maximum values noted above.

According to another aspect, the non-woven material (e.g., the spunlace polyester-based material) of the backing 102 can have a particular thickness that facilitates the formation of a coated abrasive article having the features of the embodiments herein. For example, the non-woven backing can have an average thickness of not greater than about 10 mm, such as not greater than about 9 mm, not greater than about 8 mm, not greater than about 7 mm, not greater than about 6 mm, not greater than about 5 mm, not greater than about 4 mm, not greater than about 3 mm, not greater than about 2 mm, not greater than about 1 mm, or even not greater than about 0.95 mm. Still, in another non-limiting embodiment, the non-woven material of the backing 102 can have an average thickness of at least about 0.05 mm, such as at least about 0.08 mm, at least about 0.1 mm, at least about 0.2 mm, at least about 0.3 mm, at least about 0.5 mm, or even at least about 0.6 mm. It will be appreciated that the non-woven material of the backing can have an average thickness within a range between any of the minimum and maximum values noted above.

In accordance with an embodiment, the backing 102 can have an upper major surface 104, which can be generally planar. In particular instances, the backing 102 can have an upper major surface 104 that may be particularly smooth and may facilitate the formation of a coated abrasive article having the features of the embodiments herein. For example, the upper major surface 104 can have an average surface roughness (Ra) of not greater than about 20 μm (microns) as measured by hand held surface profilometer having a diamond stylus, which is commercially available from Mitutoyo Ltd. In other instances, the upper major surface 104 can have an average surface roughness of not greater than about 18 μm, such that greater than about 15 μm, not greater than about 12 μm, or even not greater than about 10 μm. In still another non-limiting embodiment, the upper major surface 104 of the backing 102 can have an average surface roughness that is, at least about 1 μm or even at least about 2 μm. It will be appreciated that the average surface roughness of the upper major surface 104 may be within a range between any of the minimum and maximum values noted above.

In accordance with another embodiment, the backing 102 can have a generally planar lower major surface 103. In particular, lower major surface 103 may have a particular smoothness that may facilitate the formation of a coated abrasive article having the features of the embodiments herein. For example, in certain instances, the lower major surface 103 can have an average surface roughness (Ra) of not greater than about 30 μm (microns) as measured by a hand held surface profilometer having a diamond stylus, which is commercially available from Mitutoyo Ltd. In yet another instance, the lower major surface 103 can have an average surface roughness of not greater than about 30 μm, not greater than about 25 μm, not greater than about 22 μm, not greater than about 20 μm, not greater than about 18 μm. In one non-limiting embodiment, the lower major surface 103 of the backing 102 may have an average surface roughness of at least about 5 μm, such as at least about 8 μm. It will be appreciated that the lower major surface 103 of the backing 102 can have an average surface roughness within a range between any of the minimum and maximum values noted above.

As further illustrated, the backing 102, they be a substantially, uniformly planar body. For example, in at least one embodiment, the backing 102 can have a generally planar and uncorrugated contour. Moreover, while not illustrated in FIG. 1, it will be appreciated that the backing 102 can take on any suitable shape, contour, and dimensions. For example, in certain instances, the backing 102 may be in the form of a generally rectangular sheet (as viewed top-down). In still other embodiments, the backing 102 may be in the form of a disk having a circular shape (as viewed top-down). The coated abrasive articles of the embodiments herein can be in the form of belts, sheets, discs, nofil discs and the like.

In accordance with an embodiment, the backing 102 may have particular mechanical properties that can facilitate the formation of a coated abrasive article having the features of the embodiments herein. For example, in at least one embodiment, the backing 102, which can include the non-woven material and any additives (e.g., a spunlace polyester-based material and a saturant), can have a machine-direction stiffness of at least about 200 MPa as measured using an Instron 5982 with a 2 kN load cell. The samples had a total sample length of 200 mm, a sample width of 25 mm, a gauge length of 127 mm, and were tested at a deformation rate of 300 mm/min. The modulus values were generated from stress-strain data. In another embodiment, the backing 102 can have a machine-direction stiffness of at least about 210 MPa, such as at least about 20 MPa, at least about 230 MPa, at least about 40 MPa, at least about 250 MPa, at least about 260 MPa, at least about 270 MPa, at least about 280 MPa, or even at least about 290 MPa. In still another non-limiting embodiment, the backing 102 can have a machine-direction stiffness of not greater than about 400 MPa, such as, not greater than about 390 MPa, not greater than about 380 MPa, not greater than about 370 MPa, not greater than about 360 MPa, or even not greater than about 250 MPa. It will be appreciated that the machine-direction stiffness of the backing 102 can be within a range between any of the minimum and maximum values noted above.

In yet another embodiment, the backing 102 may include a cross-direction stiffness of the least about 1 MPa as measured using an Instron 5982 with a 2 kN load cell. The samples had a total sample length of 200 mm, a sample width of 25 mm, a gauge length of 127 mm, and were tested at a deformation rate of 300 mm/min. The modulus values were generated from stress-strain data. In other instances, the backing 102 can have a cross-direction stiffness of at least about 2 MPa, at least about 3 MPa, at least about 4 MPa, we spoke 5 MPa, at least about 6 MPa, at least about 7 MPa, at least about 8 MPa, or even at least about 10 MPa. In still another non-limiting embodiment, the backing 102 can have a cross-direction stiffness that is not greater than about 50 MPa, such as, not greater than about 45 MPa, not greater than about 40 MPa, not greater than about 38 MPa, not greater than about 35 MPa, or even not greater than about 33 MPa. It will be appreciated that the backing 102 can have a cross-direction stiffness within a range between any of the minimum and maximum values noted above.

In accordance with a particular embodiment, the backing may include a non-woven material including a spunlace polyester-based material as noted herein. More particularly, the non-woven material (e.g., the spunlace polyester-based material) of the backing 102 may have one or more particular mechanical properties that may facilitate the formation of a coated abrasive article having any of the features of the embodiments herein. For example, in one embodiment, the non-woven material, such as the spunlace polyester-based material, can have a machine-direction stiffness of at least about 80 MPa as measured using an Instron 5982 with a 2 kN load cell. The samples had a total sample length of 200 mm, a sample width of 25 mm, a gauge length of 127 mm, and were tested at a deformation rate of 300 mm/min. The modulus values were generated from stress-strain data. In another embodiment, the non-woven material, such as the spunlace polyester-based material, can have a machine-direction stiffness of at least about 80 MPa as measured according, such as at least about 90 MPa, at least about 100 MPa, at least about 110 MPa, at least or even at least about 120 MPa. Still, and another non-limiting embodiment, the non-woven material, such as the spunlace polyester-based material, of the backing 102 can have a machine-direction stiffness that is not greater than about 220 MPa, not greater than about 210 MPa, not greater than about 200 MPa, not greater than about 190 MPa, not greater that about 180 MPa, or even not greater than about 160 MPa. It will be appreciated that the non-woven material, such as the spunlace polyester-based material, of the backing 102 can have a machine-direction stiffness that is within a range between any of the minimum and maximum values noted above.

In accordance with another embodiment, the backing 102 can include a non-woven material, such as the spunlace polyester-based material, that may have a particular cross-direction stiffness, and which may facilitate certain properties of the coated abrasive article. For example, in one embodiment, the non-woven material, such as the spunlace polyester-based material, can have a cross-direction stiffness of the least about 1 MPa as measured using an Instron 5982 with a 2 kN load cell. The samples had a total sample length of 200 mm, a sample width of 25 mm, a gauge length of 127 mm, and were tested at a deformation rate of 300 mm/min. The modulus values were generated from stress-strain data. In another embodiment, the non-woven material, such as the spunlace polyester-based material, can have a cross-direction stiffness of at least about 2 MPa, such as at least about 3 MPa, at least about 5 MPa, or even at least about 8 MPa. In yet another embodiment, the non-woven material, such as the spunlace polyester-based material, can have a cross-direction stiffness that is not greater than about 40 MPa, such as, not greater than about 38 MPa, not greater than about 35 MPa, not greater about 33 MPa, not greater than about 30 MPa, or even not greater than about 28 MPa. It will be appreciated that, that the non-woven material, such as the spunlace polyester-based material, can have a cross-direction stiffness within a range between any of the minimum and maximum values noted above.

In certain instances, the non-woven material, such as the spunlace polyester-based material, of the backing 102 can have a particular porosity facilitating certain finishing processes and features of the coated abrasive particles of the embodiments herein. For example, in one embodiment, the non-woven material, such as the spunlace polyester-based material, of not greater than about 25 vol % for a total volume of the backing 102. In yet another embodiment, the porosity of the non-woven material, such as the spunlace polyester-based material, can be not greater than about 20 vol %, such as, not greater than about 15 vol %, at least about 12 vol %, not greater than about 10 vol %, not greater than about 8 vol %, not greater than about 6 vol %, or even not greater than about 4 vol %. Still another embodiment, the non-woven material, such as the spunlace polyester-based material, of the backing 102 can have a porosity that is at least about 1 vol %, such as at least about 2 vol %, at least about 4 vol %, at least about 6 vol %, at least about 8 vol %, or even at least about 10 vol %. It will be appreciated that the non-woven material, such as the spunlace polyester-based material, of the backing 102 can have a porosity within a range between any of the minimum and maximum values noted above.

The non-woven material of the backing may be subject to one or more processes to form a coated abrasive article according to the embodiments herein. Referring again to FIG. 1, as illustrated, the backing 102, including the non-woven material (e.g., a spunlace polyester-based material) can have a certain content of porosity and may be subject to one or more finishing processes, including for example a saturation process. In a saturation process a saturant 130 can be introduced into the porosity of the non-woven material of the backing 102. The saturation process can include dipping the non-woven material into the saturant, for a duration sufficient to ensure impregnation of the saturant into the non-woven material. After saturation, the backing including the non-woven material and the saturant can be thermally processed to facilitate curing of the saturant material. Thermal processing may be conducted by utilizing a controlled heating process from approximately 100° C. to the cure temperature, which for certain saturant formulations can be between approximately 150° C. to approximately 190° C. The controlled heating process may facilitate limited uncontrolled evolution of water and blistering of the backing.

According to a particular aspect, the saturant can be contained within the porosity of the non-woven material, and particularly, particularly contained within the porosity of the spunlace polyester-based material. In particular instances, the saturant may be a material selected from the group comprising of the phenolic resin, acrylic, urea resin, and a combination thereof. According to one embodiment, the saturant consists essentially of (at least about 98%) urea-formaldehyde resin.

The saturant may extend substantially uniformly throughout an entire volume of the non-woven material (e.g., the spunlace polyester-based material) of the backing 102. For example, the saturant 130 may extend substantially uniformly throughout an entire thickness 105 of the non-woven material (e.g., the spunlace polyester-based material) of the backing 102. Moreover, in certain instances, the saturant 130 may be substantially disposed within the pores of the non-woven material (e.g., the spunlace polyester-based material). In other structures according to embodiments herein, the saturant 130 can be substantially uniformly distributed throughout the entire volume of the non-woven material (e.g., the spunlace polyester-based material), such that the content of the saturant 130 may be substantially uniform at the major surface 104, the lower major surface 103, and any region in between within the interior volume of the backing 102.

In yet other instances, the saturation process can be conducted to create a non-uniformly distributed content of the saturant 130 within particular regions of the backing 102. For example, in at least one embodiment, the saturant 130 can be non-uniformly dispersed throughout an entire volume of the non-woven material (e.g., the spunlace polyester-based material) of the backing 102. For instance, in certain designs, the saturant 130 may extend substantially non-uniformly throughout an entire thickness 105 of the non-woven material (e.g., the spunlace polyester-based material). In yet another alternative embodiment, the saturant 130 may be preferentially disposed at a major surface (e.g., the upper major surface 104) of the non-woven material (e.g., the spunlace polyester-based material) of the backing 102 as compared to another region within the backing (e.g., the lower major surface 103). The content of the saturant 130 can be different at a major surface (e.g., upper major surface 104) of the non-woven material (e.g., the spunlace polyester-based material) as compared to an interior region spaced away from the major surface of the non-woven material (e.g., the spunlace polyester-based material) and the backing 102. For example, the content of the saturant 130 may be greater at a major surface of the non-woven material (e.g., the spunlace polyester-based material) as compared to an interior region, such as a mid-region 111 defined as a plane extending parallel to the major surfaces of the backing 102 and extending between the upper major surface 104 and lower major surface 103 of the backing 102. In yet a more particular embodiment, the saturation process may be conducted in a particular manner such that the content of saturant 130 at the upper major surface 104 may be different than the content of the saturant 130 at the lower major surface 103. In certain instances, the content of saturant 130 at the upper major surface 104 may be greater than the content of the saturant 130 at the lower major surface 103.

The backing may have a particular saturant/backing content ratio (Cs/Cp) that may facilitate the formation of the coated abrasive articles of the embodiments herein. According to the saturant/backing content ratio, "Cs" can represent a weight percent of the saturant 130 for a total weight of the backing 102 and "Cb" can represent a weight percent of the non-woven material (e.g., the spunlace polyester-based material) for a total weight of the backing 103. In accordance with an embodiment, the backing can have a saturant/backing content ratio that is not greater than about 1. In other instances, the saturant/backing content ratio can be not greater than about 0.9, such as, not greater than about 0.8, not greater than about 0.7, not greater than about 0.6, not greater than about 0.5, not greater than about 0.4, not greater than about 0.35, not greater than about 0.3, not greater than about 0.25, not greater than about 0.2, not greater than about 0.15, not greater than about 0.1, or even not greater than about 0.08. In still another non-limiting embodiment, the saturant/backing content ratio can be at least about 0.01, such as at least about 0.02, at least about 0.03, at least about 0.05, at least about 0.08, or even at least about 0.1. It will be appreciated that the saturant/backing content ratio can be within a range between any of the minimum and maximum values noted above.

According to one embodiment, the saturant can have a particular areal density that may facilitate the formation of a coated abrasive article having the features of the embodiments herein. For example, the saturant can have an area density of at least 5 grams per square meter (i.e., $g/m^2$ or GSM), such as at least about 10 GSM, such as at least about 20 GSM, at least about 30 GSM, at least about 40 GSM, or even at least about 50 GSM. Still, and another embodiment, the saturant can have an areal density of not greater than about 200 GSM, such as, not greater than about 150 GSM, such not greater than about 100 GSM, not greater than about 90 GSM, not greater than about 80 GSM, or even not greater than about 70 GSM. It will be appreciated that the saturant can have an areal density within a range between any of the minimum and maximum values noted above.

In certain aspects, the backing 102, including the non-woven material, saturant, and any additives may have a particular porosity. For example, in one embodiment, the backing 102 can have an air porosity value of at least about 0.1 seconds/hundred cc of air, which is measured according to the standardized air porosity test using Texto Crafts Air permeability tester. The testing procedure for measuring the air porosity is conducted by first raising a cylinder of the instrument to a ready position and clamping the backing material between two clamping plates at a time of 0.0 seconds. The cylinder is released until it reaches a steady state, at which time the timer is started (t1) to begin measurements. The instrument is closed and the initial marks; is noted as M1. The cylinder continues to drop until it reaches a set location and the measurement stops and M2 and t2 are recorded. The porosity of the backing is calculated according to the equation $[(t2-t1)/(M1-M2)]\times100$ and reported in seconds per 100 cc of air. In yet another embodiment, the backing 102 can have an air porosity value of at least about 0.5 seconds/100 cc, such as at least about 1 second/100 cc, at least about 2 seconds/100 cc, at least about 4 seconds/100 cc, at least about 7 seconds/100 cc, at least about 10 seconds/100 cc, at least about 12 seconds/100 cc, at least about 15 seconds/100 cc, or even at least about 20 seconds/100 cc. Still, in a non-limiting embodiment, the air porosity value of the backing 102 maybe not greater than about 100 seconds/100 cc, such as, not greater than 90 seconds/100 cc, not greater than about 80 seconds/100 cc, not greater than about 60 seconds/100 cc, or even not greater than about 40 seconds/100 cc. It will be appreciated that the air porosity value of the backing 102 maybe within a range between any of the minimum and maximum values noted above.

Moreover, the backing may have a particular water absorption value as measured according to the Cobb Test using a Cobb Size Tester that may facilitate formation of a coated abrasive article having the features of the embodiments herein. The testing procedure for measuring the water absorption value of the backing includes preparing two samples and measuring the weight of the samples to an accuracy of 0.01 grams. Mark the samples with a P or C to indicate print side or coat side. Clamp the sample into the instrument on the rubber side of the claim, with an orientation to maintain the coat size of the backing on rubber side of clamping plate, keeping the coat side up. Rotate the assembly to the test position and pour 100 cc of distilled water onto the sample beginning at time 0.0 seconds. The test duration is 60 seconds. At 50-55 seconds pour off the water by rotating the sample to the release position and remove the sample. Remove the excess water, roll the sample forward and backwards once. Fold the sample with tested (i.e., wetted) area inside and reweigh the sample quickly. Repeat the same for opposite side. For example, in one instance, the backing 102 can have a water absorption value of not greater than about 60, such as, not greater about 55, not greater about 50, not greater than about 45, not greater than about 40, not greater than about 35, or even not greater than about 30. In yet another embodiment, the backing can have a water absorption value of at least about 1, such as at least about 5, or even at least about 8. It will be appreciated that the backing 102 can have a water absorption value within a range between any of the minimum maximum values noted above.

In certain instances, the non-woven material (e.g., the spunlace polyester-based material) of the backing 102 can have a particular machine-direction shear modulus, which may facilitate the formation of a coated abrasive article having the features of the embodiments herein. For example, the non-woven material (e.g., the spunlace polyester-based material) of the backing 102 can have a machine-direction shear modulus of the least about 100 MPa as measured using an Instron 5982 with a 2 kN load cell. The samples had a total sample length of 200 mm, a sample width of 25 mm, a gauge length of 127 mm, and were tested at a deformation rate of 300 mm/min. The modulus values were generated from stress-strain data. In another embodiment, the machine-direction shear modulus of the non-woven material of the backing 102 can be not greater than about 90 MPa, such as, not greater than about 80 MPa, not greater than about 70 MPa, or even not greater than about 60 MPa. Still in another embodiment, the non-woven material of the backing 102 can have a machine-direction shear modulus of at least about 10 MPa, such as at least about 20 MPa, at least about 30 MPa, or even at least about 40 MPa. It will be appreciated that the non-woven material of the backing 102 can have a machine-direction shear modulus within a range between any of the minimum and maximum values noted above.

In still another embodiment, the non-woven material (e.g., the spunlace polyester-based material) of the backing 102 can have a particular cross-direction shear modulus facilitating the formation of a coated abrasive article having the features of the embodiments herein. For example, the non-woven material of the backing 102 may have a cross-direction shear modulus of not greater than about 15 MPa, such as, not greater than about 12 MPa, not greater than about 10 MPa, not greater than about 9 MPa, or even not greater than about 8 MPa. In yet another non-limiting embodiment, the non-woven material of the backing 102 can have a cross-direction shear modulus of at least but 1 MPa, such as at least about 2 MPa, at least about 3 MPa, or even at least about 4 MPa. It will be appreciated that non-woven material of the backing 102 can have a cross-direction shear modulus within a range between any of the minimum and maximum values noted above.

Furthermore, in accordance with an embodiment, the backing can include one or more additives. For example, some suitable additives can include catalysts, coupling agents, current, antistatic agents, suspending agents, anti-loading agents, lubricants, wetting agents, dyes, fillers, viscosity modifiers, dispersants, default worse, and grinding agents. It will be appreciated that the backing can include one or more combinations of additives as described herein. The additives can be provided by any suitable methods as known to those of skill in the art.

Moreover, the backing may have a particular average thickness facilitating the formation of a coated abrasive article having the features of the embodiments herein. For example, the backing, which can include the non-woven material and additives (e.g., a saturant) can have an average thickness of not greater than about 10 mm, such as not greater than about 9 mm, not greater than about 8 mm, not greater than about 7 mm, not greater than about 6 mm, not greater than about 5 mm, not greater than about 4 mm, not greater than about 3 mm, not greater than about 2 mm, or even not greater than about 1 mm In yet another non-limiting embodiment, the backing can have an average thickness of at least about 0.05 mm, such as at least about 0.08 mm, at least about 0.1 mm, at least about 0.2 mm, at least about 0.3 mm, or even at least about 0.5 mm. It will be appreciated that the backing can have an average thickness within a range between any of the minimum and maximum values noted above.

After forming the backing, which can include a non-woven material, an optional saturant, and optional fillers, additional layers may be formed on the backing 102. That is, one or more optional layers of material may be selectively placed on or over one or more of the major surfaces of the backing 102. For example, in one embodiment, the body 101 can include an optional frontfill layer 121 overlying a major surface, such as the upper major surface 104, of the backing 102. In particular instances, the frontfill layer 121 can be in direct contact with a major surface, such as the upper major surface 104, of the backing 102. More particularly, in certain instances, the frontfill layer 121 may be bonded directly to and abutting a major surface of the backing 102, including for example, the upper major surface 104 of the backing 102.

In certain instances, the frontfill layer 121 may include an organic material. More particularly, the frontfill layer 121, may include a material, such as a phenolic resin, epoxy resin, urea resin, polyurethane, polyamide, polyethylene, polyacrylates, polymethacrylate, polyvinyl chloride, polysiloxane, silicone, cellulose acetate, nitrocellulose, natural rubber, starch, shellac, and a combination thereof. In accordance with one particular embodiment, the frontfill layer 121 may be made of a phenolic resin, epoxy resin, urea resin, and a combination thereof. Particularly, the frontfill layer 121 may consist essentially of a phenolic resin. In an alternative embodiment, the frontfill layer 121 may consist essentially of an epoxy resin. For yet another instance, the frontfill layer 121 may consist essentially of a urea resin. In other instances, the frontfill layer 121 may consist essentially of polyethylene, such as high density polyethylene.

According to one particular embodiment, the mixture used to form the front fill layer 121, and in certain instances, the frontfill layer 121 itself may include a mixture of acrylic resin, phenolic resin, and certain additives, wherein the content of the components does not exceed 100 wt %. For example, in one embodiment, the frontfill layer 121 can include at least about 5 wt % acrylic resin for the total weight of the mixture or frontfill layer 121. In other instances, the content of the acrylic resin within the mixture used to form the frontfill layer 121, and in certain instances, the frontfill layer 121 itself, can be at least about 10 wt %, at least about 15 wt %, at least about 20 wt %, at least about 25 wt %, or even at least about 30 wt %. Yet, in another non-limiting embodiment, the mixture used to form the frontfill layer 121, and in certain instance, the frontfill layer 121 itself, can have a content of acrylic resin of not greater than about 70 wt %, such as not greater than about 60 wt %, or even not greater than about 50 wt %. It will be appreciated that the content of acrylic resin within the mixture used to form the frontfill layer 121, and in certain instances, the final-formed frontfill layer 121, can be within a range between any of the minimum and maximum percentages noted above.

As described herein, the mixture used to form the frontfill layer 121, and in certain instances, the final-formed frontfill layer 121, may include at least about 0.1 wt % acrylic resin for the total weight of the mixture or make coat 231. In other instances, the content of the phenolic resin within the mixture used to form the make coat, and in certain instances, the final-formed make coat 231, can be at least about 1 wt %, at least about 5 wt %, at least about 8 wt %, at least about 10 wt %, such as at least about 15 wt %, or even at least about 18 wt % for a total weight of the mixture or the total weight of the frontfill layer 121. Yet, in another non-limiting embodiment, the mixture used to form the frontfill layer 121, and in certain instance, the frontfill layer 121 itself, can have a content of phenolic resin of not greater than about 70 wt %, such as not greater than about 60 wt %, not greater than about 50 wt %, or even not greater than about 30 wt %. It will be appreciated that the content of phenolic resin within the mixture used to form the frontfill layer 121, and in certain instances, the final-formed frontfill layer 121, can be within a range between any of the minimum and maximum percentages noted above.

As further noted herein, the mixture used to form the frontfill layer 121, and in certain instances, the frontfill layer 121 itself may include a certain content of an additive, including for example, but not limited to, a carbonate, such as calcium carbonate. According to at least one embodiment, the mixture used to form the frontfill layer 121, and in certain instances, the frontfill layer 121 itself, can have a content of an additive of at least about 0.1 wt %, such as at least about 5 wt %, at least about 10 wt %, at least about 20 wt %, or even at least about 40 wt % for a total content of the mixture or the frontfill layer 121. Yet, in another non-limiting embodiment, the mixture used to form the frontfill layer 121, and in certain instance, the frontfill layer 121 itself, can have a content of additive (e.g., calcium carbonate) of not greater than about 70 wt %, not greater than about 60 wt %, or even not greater than about 50 wt %. It will be appreciated that the content of an additive within the mixture used to form the frontfill layer 121, and in certain instances, the final-formed frontfill layer, can be within a range between any of the minimum and maximum percentages noted above.

Moreover, the mixture used to form the frontfill layer 121, and in certain instances, the frontfill layer 121 itself may include a certain content of a thickener, including for example, but not limited to, a carbonate, such as an anionic thickener. According to at least one embodiment, the mixture used to form the frontfill layer 121, and in certain instances, the frontfill layer 121 itself, can have a content of thickener of at least about 0.1 wt %, such as at least about 0.5 wt %, or even at least about 0.8 wt % for a total content of the mixture or the frontfill layer 121. Yet, in another non-limiting embodiment, the mixture used to form the frontfill layer 121, and in certain instance, the frontfill layer 121 itself, can have a content of a thickener of not greater than about 10 wt %, such as not greater than about 6 wt %, or even not greater than about 3 wt %. It will be appreciated that the content of a thickener within the mixture used to form the frontfill layer 121, and in certain instances, the final-formed frontfill layer, can be within a range between any of the minimum and maximum percentages noted above.

Moreover, the frontfill layer may have a particular construction facilitating the formation of a coated abrasive article having the features of the embodiments herein. For example, the frontfill layer 121 can have an areal density of at least 1 gram per square meter (i.e., $g/m^2$ or GSM). In another embodiment, the frontfill layer 121 can have an areal density of at least about 5 GSM, such as at least about 10 GSM, at least about 15 GSM, at least about 20 GSM, at least about 20, GSM, at least about 25 GSM, at least about 30 GSM, at least about 35 GSM, at least about 40 GSM, or even at least about 45 GSM. Still, and another embodiment, the frontfill layer 121 can have an areal density of not greater than about 100 GSM, such as, not greater than about 90 GSM, such not greater than about 80 GSM, not greater than about 70 GSM, not greater than about 60 GSM, or even not greater than about 50 GSM. It will be appreciated that the frontfill layer 121 can have an areal density within a range between any of the minimum and maximum values noted above.

As further illustrated in FIG. 1, the backing 102 may include one or more optional layers, including for example, a backfill layer 122 configured to overlie a major surface of the backing 102, and more particularly, the lower major surface 103 of the backing 102. In particular instances, the backfill layer 122 may be in direct contact with a major surface of the backing 102, such as the lower major surface 103 of the backing 102. In accordance with an embodiment, the backfill layer 122 may include an organic material, such as a phenolic resin, epoxy resin, urea resin, polyurethane, polyamide, polyethylene, polyacrylates, polymethacrylate, polyvinyl chloride, polysiloxane, silicone, cellulose acetate, nitrocellulose, natural rubber, starch, shellac, low density polyethylene, high density polyethylene, and a combination thereof. In at least one embodiment, the backfill layer 122 can consist essentially of high density polyethylene. The backfill layer 122 can have any of the characteristics of the frontfill layer 121 of the embodiments herein, including but not limited to, areal density.

As noted herein, and referring again to FIG. 1, the coated abrasive article 100 can include an abrasive layer 107 overlie the backing 102. In accordance with an embodiment, the abrasive layer 107 can include at least one coating layer overlying the backing 102. Some suitable examples of coating layers can include a make coat, size coat, pre-sized coat, supersize coat, and a combination thereof. It will be appreciated that any one of the coating layers may be optional.

Figure 2:
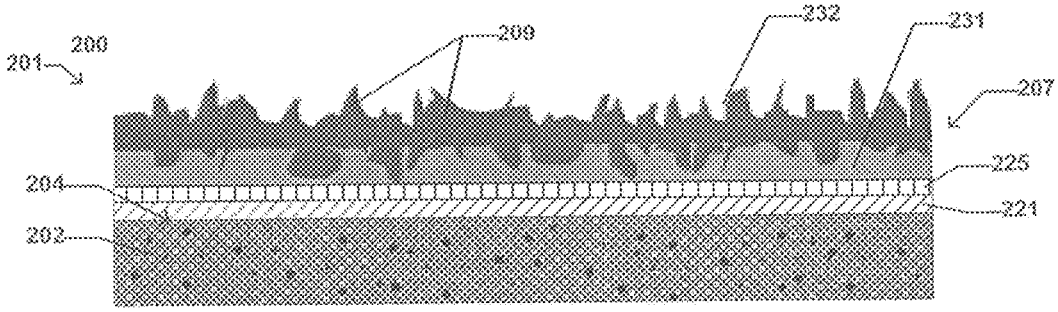
FIG. 2 includes a cross-sectional illustration of a portion of a coated abrasive article in accordance with an embodiment.

FIG. 2 includes a cross-sectional illustration of a portion of a coated abrasive article in accordance with an embodiment. As illustrated in FIG. 2, the coated abrasive article 200 can include the body 201. The body 201 may include a backing 202 having any of the features of backings described in embodiments herein. Furthermore, the backing 202 may include a major surface, and more particularly, an upper major surface 204. The body 201 may further include an optional layer 221 overlying the backing 202, which in certain instances can be a frontfill layer having any of the features of a frontfill layer according to the embodiments herein. The body 201 may further include an intermediate layer 225 overlying the backing 202. The intermediate layer 225 may be an optional layer. Furthermore, the intermediate layer 225 may be bonded directly to a major surface of the backing 202, including for example, the upper major surface 204, the backing 202. However, in alternative embodiments, one or more intervening layers, such as the optional layer 221 may be disposed between the intermediate layer 225 and the backing 202.

In accordance with one embodiment, the intermediate layer 225 can include various materials, including but not limited to an inorganic material, an organic material, a polymer, cloth, paper, film, fabric, fleeced fabric, vulcanized fiber, woven material, non-woven material, webbing, polymer, resin, phenolic resin, phenolic-latex resin, epoxy resin, polyester resin, urea formaldehyde resin, polyester, polyurethane, polypropylene, polyimides, and a combination thereof. In one particular embodiment, the intermediate layer may include a woven material, such as a woven fabric, such as a woven cotton material.

For at least one aspect, the intermediate layer 225 may include a woven cotton material, wherein the woven cotton material has an average areal density of at least about 10 $g/m^2$. In other embodiments, the areal density of the woven cotton material of the intermediate layer 225 can be at least about 20 $g/m^2$ or even at least about 30 $g/m^2$. In still another embodiment, the woven cotton material can have an areal density of not greater than about 150 $g/m^2$, such as not greater than about 120 $g/m^2$, or even not greater than about 100 $g/m^2$. It will be appreciated that the area density of the intermediate layer 225 may be within a range between any of the minimum and maximum values noted above.

As further illustrated in FIG. 2, the coated abrasive article 200 can include a body 201, including and abrasive layer 207 overlying the backing 202. As illustrated, the abrasive layer 207 may be in indirect contact with the backing 202, including one or more intervening layers, including for example the optional layer 221 and the intermediate layer 225 disposed between the backing 202 and the abrasive layer 207. However, it will be appreciated that in certain other instances, the abrasive layer 207 may be in direct contact and abutting an upper major surface 204, the backing 202.

In accordance with an embodiment, the abrasive layer 207 can include a coating layer overlying the backing 202. The coating layer can include one or more layers or films of material facilitating the attachment of the abrasive particles 209 to the backing 202. For example, some suitable coating layers can include at least one of a make coat, a size coat, a pre-size coat, a supersize coat, and a combination thereof. The coating layer can be formed using one or more processes as understood by those skilled in the art, including but not limited to, deposition, coating, rolling, gravure, curing, radiating, heating, and a combination thereof.

Referring particularly to the coated abrasive article of FIG. 2, the abrasive layer 207 can include a coating layer including a make coat 231. The make coat 231 may overlie the backing 202, and more particularly, may be coupled to an upper major surface 204 of the backing 202. As will be appreciated, in certain instances, the make coat 231 may be spaced apart and indirectly coupled to the upper major surface 204 of the backing 201 by one or more intervening layers, including for example, optional layer 221 and/or the intermediate layer 225. Still, in an alternative embodiment, the make coat 231 may be bonded directly to at least a portion of the backing 202, such as the upper major surface 204, of the backing 202.

In accordance with an embodiment, the make coat 231 can include an organic material. Some suitable organic materials can include a polymeric material, and more particularly, a phenolic resin, acrylic, urea resin, epoxy resin, polyurethane, polyamide, polyacrylate, polymethacrylate, polyvinyl chloride, polyethylene, polysiloxane, silicone, cellulose acetate, nitrocellulose, natural rubber, starch, shellac, and a combination thereof.

According to one particular embodiment, the make coat 231 can include a mixture of a phenolic resin, acrylic resin, and at least one additive that may facilitate formation of a coated abrasive article having the features of the embodiments herein. It will be appreciated that ranges of components are given, but the total content will not exceed 100%. The mixture used to form the make coat 231, and in certain instances, the composition of the final make coat 231, may include a ratio of the weight percent of the phenolic resin to the weight percent of the acrylic resin based on the total weight of components within the make coat 231 of at least about 1:1 (wt % phenolic resin:wt % acrylic resin), at least about 2:1, at least about 3:1, at least about 4:1, or even at least about 6:1. Still, in another embodiment, the ratio of phenolic resin to weight percent acrylic resin may be not greater than about 20:1, not greater than about 18:1 or even not greater than about 14:1. The ratio of phenolic resin to acrylic resin may be within a range between any of the ratios noted above.

More particularly, the mixture used to form the make coat 231, and in certain instances, the make coat 231 itself may include at least about 10 wt % phenolic resin for the total weight of the mixture or make coat 231. In other instances, the content of the phenolic resin within the mixture used to form the make coat, and in certain instances, the make coat 231 itself, can be at least about 15 wt %, at least about 20 wt %, at least about 25 wt %, at least about 30 wt %, or even at least about 35 wt %. Yet, in another non-limiting embodiment, the mixture used to form the make coat 231, and in certain instance, the make coat 231 itself, can have a content of phenolic resin of not greater than about 70 wt %, not greater than about 60 wt %, or even not greater than about 50 wt %. It will be appreciated that the content of phenolic resin within the mixture used to form the make coat 231, and in certain instances, the final-formed make coat 231, can be within a range between any of the minimum and maximum percentages noted above.

In another embodiment, mixture used to form the make coat 231, and in certain instances, the final-formed make coat 231, may include at least about 0.1 wt % acrylic resin for the total weight of the mixture or make coat 231. In other instances, the content of the acrylic resin within the mixture used to form the make coat, and in certain instances, the final-formed make coat 231, can be at least about 1 wt %, at least about 2 wt %, at least about 2.5 wt %, at least about 3 wt %, such as at least about 3.5 wt %. Yet, in another non-limiting embodiment, the mixture used to form the make coat 231, and in certain instance, the make coat 231 itself, can have a content of acrylic resin of not greater than about 30 wt %, not greater than about 20 wt %, not greater than about 10 wt %, or even not greater than about 7 wt %. It will be appreciated that the content of acrylic resin within the mixture used to form the make coat 231, and in certain instances, the final-formed make coat 231, can be within a range between any of the minimum and maximum percentages noted above.

In certain instances, the mixture used to form the make coat 231, and in certain instances, the make coat 231 itself may include a certain content of an oxide additive, including for example, but not limited to, iron oxide. According to at least one embodiment, the mixture used to form the make coat 231, and in certain instances, the make coat 231 itself, can have a content of iron oxide of at least about 0.1 wt %, such as at least about 0.2 wt %, at least about 0.3 wt %, at least about 0.4, or even at least about 0.5 wt % for a total content of the mixture or the make coat 231. Yet, in another non-limiting embodiment, the mixture used to form the make coat 231, and in certain instance, the make coat 231 itself, can have a content of iron oxide of not greater than about 7 wt %, not greater than about 3 wt %, or even not greater than about 1.5 wt %. It will be appreciated that the content of iron oxide within the mixture used to form the make coat 231, and in certain instances, the final-formed make coat 231, can be within a range between any of the minimum and maximum percentages noted above.

As further noted herein, the mixture used to form the make coat 231, and in certain instances, the make coat 231 itself may include a certain content of an additive, including for example, but not limited to, a carbonate, such as calcium carbonate. According to at least one embodiment, the mixture used to form the make coat 231 and in certain instances, the make coat 231 itself, can have a content of an additive of at least about 0.1 wt %, such as at least about 5 wt %, at least about 10 wt %, at least about 20 wt %, at least about 40 wt %, or even at least about 50 wt % for a total content of the mixture or the make coat 231. Yet, in another non-limiting embodiment, the mixture used to form the make coat 231, and in certain instance, the make coat 231 itself, can have a content of additive (e.g., calcium carbonate) of not greater than about 70 wt %, not greater than about 60 wt %, or even not greater than about 55 wt %. It will be appreciated that the content of an additive within the mixture used to form the make coat 231, and in certain instances, the final-formed make coat 231, can be within a range between any of the minimum and maximum percentages noted above.

As further illustrated in FIG. 2, the body 201 can include abrasive layer 207, including a coating layer comprising a size coat 232. Notably, the size coat can overlie a portion of the make 231. More particularly, the size coat 232 may also overlie at least a portion of the abrasive particles 209 and facilitate securing the abrasive particles 209 to the backing 202. In accordance with a particular embodiment, the size coat 232 may be bonded directly to a portion of the abrasive particles 209.

In accordance with an embodiment, the size coat 232 can include an organic material. Some suitable organic materials can include a polymeric material, and more particularly, a phenolic resin, acrylic, urea resin, epoxy resin, polyurethane, polyamide, polyacrylate, polymethacrylate, polyvinyl chloride, polyethylene, polysiloxane, silicone, cellulose acetate, nitrocellulose, natural rubber, starch, shellac, and a combination thereof.

According to one particular embodiment, the size coat 232 can include a mixture of a phenolic resin, acrylic resin, and additives. It will be appreciated that while ranges of such components are included the total content of materials in the size coat 232 does not exceed 100%. The mixture used to form the size coat 232, and in certain instances, the composition of the final-formed size coat 232, may include a ratio of the weight percent of the phenolic resin to the weight percent of the acrylic resin based on the total weight of components within the size coat 232 of at least about 1:1 (wt % phenolic resin:wt % acrylic resin), such as at least about 2:1, at least about 3:1, at least about 4:1, or even at least about 6:1. Still, in another embodiment, the ratio of phenolic resin to weight percent acrylic resin may be not greater than about 20:1, not greater than about 18:1 or even not greater than about 14:1. The ratio of phenolic resin to acrylic resin within the mixture or the final-formed size coat 232 may be within a range between any of the ratios noted above.

More particularly, the mixture used to form the size coat 232, and in certain instances, the size coat 232 itself may include at least about 10 wt % phenolic resin for the total weight of the mixture or size coat 232. In other instances, the content of the phenolic resin within the mixture used to form the size coat 232, and in certain instances, the final-formed size coat 232, can be at least about 15 wt %, such as at least about 20 wt %, at least about 25 wt %, at least about 30 wt %, or even at least about 40 wt %. Yet, in another non-limiting embodiment, the mixture used to form the size coat 232, and in certain instance, the size coat 232 itself, can have a content of phenolic resin of not greater than about 70 wt %, such as not greater than about 60 wt %, or even not greater than about 55 wt %. It will be appreciated that the content of phenolic resin within the mixture used to form the size coat 232, and in certain instances, the final-formed size coat 232, can be within a range between any of the minimum and maximum percentages noted above.

In another embodiment, the mixture used to form the size coat 232, and in certain instances, the final-formed size coat 232, may include at least about 0.1 wt % acrylic resin for the total weight of the mixture or size coat 232. In other instances, the content of the acrylic resin within the mixture used to form the size coat 232, and in certain instances, the final-formed size coat 232, can be at least about 1 wt %, at least about 2 wt %, at least about 2.5 wt %, at least about 3 wt %, such as at least about 3.5 wt %. Yet, in another non-limiting embodiment, the mixture used to form the size coat 232, and in certain instance, the size coat 232 itself, can have a content of acrylic resin of not greater than about 30 wt %, not greater than about 20 wt %, not greater than about 10 wt %, or even not greater than about 7 wt %. It will be appreciated that the content of acrylic resin within the mixture used to form the size coat 232, and in certain instances, the final-formed size coat 232, can be within a range between any of the minimum and maximum percentages noted above.

In certain instances, the mixture used to form the size coat 232, and in certain instances, the size coat 232 itself may include a certain content of an additive, including for example, an oxide, such as iron oxide. According to at least one embodiment, the mixture used to form the size coat 232, and in certain instances, the size coat 232 itself, can have a content of iron oxide of at least about 0.1 wt %, such as at least about 0.2 wt %, at least about 0.3 wt %, at least about 0.5, or even at least about 0.8 wt % for a total. Yet, in another non-limiting embodiment, the mixture used to form the size coat 232, and in certain instance, the size coat 232 itself, can have a content of iron oxide content of not greater than about 7 wt %, not greater than about 5 wt %, or even not greater than about 3 wt %. It will be appreciated that the content of iron oxide within the mixture used to form the size coat 232, and in certain instances, the final-formed size coat 232, can be within a range between any of the minimum and maximum percentages noted above.

Additionally, the mixture used to form the size coat 232, and in certain instances, the size coat 232 itself may include a certain content of an additive, including for example, but not limited to, a carbonate, such as calcium carbonate. According to at least one embodiment, the mixture used to form the size coat 232 and in certain instances, the size coat 232 itself, can have a content of an additive of at least about 0.1 wt %, such as at least about 5 wt %, at least about 10 wt %, at least about 20 wt %, at least about 40 wt %, or even at least about 50 wt % for a total content of the mixture or the size coat 232. Yet, in another non-limiting embodiment, the mixture used to form the size coat 232, and in certain instance, the size coat 232 itself, can have a content of additive (e.g., calcium carbonate) of not greater than about 70 wt %, not greater than about 60 wt %, or even not greater than about 55 wt %. It will be appreciated that the content of an additive within the mixture used to form the size coat 232, and in certain instances, the final-formed size coat 232, can be within a range between any of the minimum and maximum percentages noted above.

Again, referring to FIG. 2, the coated abrasive article 200 can include body 201, including abrasive particles 209 overlying the backing 202. More particularly, the abrasive particles may be secured to the backing, using one or more of the layers as described in embodiments herein. In accordance with an embodiment, the abrasive particles 209 can include a polycrystalline material, amorphous material, and a combination thereof. The abrasive particles 209 may be any mineral-based abrasive particulate materials or mineral-based abrasive compositions known in the art. Examples of suitable abrasive compositions can include non-metallic, inorganic materials such as nitrides, oxides, carbides, borides, oxynitrides, superabrasive and a combination thereof. In yet another instance, the abrasive particles 209 may include an oxide, such as aluminum oxide, zirconium oxide, titanium oxide, yttrium oxide, chromium oxide, strontium oxide, silicon oxide, cerium oxide, and a combination thereof. In at least one particular embodiment, the abrasive particles 209 may include alumina, and more particularly, may consist essentially of alumina. According to one aspect, the abrasive particles 209 can include a seeded sol gel-based abrasive material. For example, suitable seeded sol-gel materials can include polycrystalline materials having an average grain size of not greater than about 1 μm. In an embodiment, the abrasive particles 209 can include abrasive grits, abrasive grains, abrasive agglomerates, abrasive aggregates, or combinations thereof, which can be included in the polymer binder formulation of the abrasive layer 207. Moreover, it will be appreciated that certain carbonaceous materials, such as diamond, which broadly includes synthetic diamond, diamond-like carbon, and related carbonaceous materials such as fullerite and aggregate diamond nanorods may be used in the abrasive layer 207, and more particularly be used as the abrasive particles 209. The abrasive particles 208 can also include naturally-occurring mined minerals, such as garnet, cristobalite, quartz, corundum, feldspar, by way of example. In addition, in certain embodiments according to the present invention, mixtures of two or more different abrasive particles can be used in the same abrasive product.

The coated abrasive article may include abrasive particles having an irregular-shaped contour, which may be akin to abrasive particles form through conventional crushing processes. Still, the abrasive particles may include shaped abrasive particles having an engineer contour, including for example, but not limited to polygonal shapes. In one particular embodiment, the abrasive particles can include shaped abrasive particles having a substantially triangular two-dimensional shape. Moreover, it will be appreciated that the coated abrasive article may include a combination of various abrasive particles, including for example a combination of shaped abrasive particles and non-shaped abrasive particles.

Furthermore, the coated abrasive articles of the embodiments herein can include a single layer of the abrasive particles 209 in an open-coat configuration or a closed-coat configuration. For example, the plurality of abrasive particles 209 can define an open-coat abrasive product having a coating density of abrasive particles of not greater than about 70 particles/$cm^2$. In other instances, the density of abrasive particle 209 per square centimeter of the open-coat abrasive article may be not greater than about 65 particles/$cm^2$, such as not greater than about 60 particles/$cm^2$, not greater than about 55 particles/$cm^2$, or even not greater than about 50 particles/$cm^2$. Still, in one non-limiting embodiment, the density of the open-coat coated abrasive using the abrasive particles 209 can be at least about 5 particles/$cm^2$, or even at least about 10 particles/$cm^2$. It will be appreciated that the density of abrasive particles 209 per square centimeter of an open-coat coated abrasive article can be within a range between any of the above minimum and maximum values.

In an alternative embodiment, the plurality of abrasive particles 209 can define a closed-coat abrasive product having a coating density of abrasive particles 209 of at least about 75 particles/$cm^2$, such as at least about 80 particles/$cm^2$, at least about 85 particles/$cm^2$, at least about 90 particles/$cm^2$, or even at least about 100 particles/$cm^2$. Still, in one non-limiting embodiment, the density of the closed-coat coated abrasive using the abrasive particle herein can be not greater than about 500 particles/$cm^2$. It will be appreciated that the density of abrasive particles 209 per square centimeter of the closed-coat abrasive article can be within a range between any of the above minimum and maximum values.

In certain instances, the coated abrasive article can have an open-coat density of a coating not greater than about 50% of abrasive particle covering the exterior abrasive surface of the article. In other embodiments, the percentage coating of the abrasive particles relative to the total area of the abrasive surface can be not greater than about 40%, not greater than about 30%, not greater than about 25%, or even not greater than about 20%. Still, in one non-limiting embodiment, the percentage coating of the abrasive particles relative to the total area of the abrasive surface can be at least about 5%, such as at least about 10%, at least about 15%, at least about 20%, at least about 25%, at least about 30%, at least about 35%, or even at least about 40%. It will be appreciated that the percent coverage of shaped abrasive particles for the total area of abrasive surface can be within a range between any of the above minimum and maximum values.

Some coated abrasive articles of the embodiments may have a particular content of abrasive particles for a length (e.g., ream) of the backing or the substrate. For example, in one embodiment, the abrasive article may utilize a normalized weight of abrasive particles of at least about 20 lbs/ream, such as at least about 25 lbs/ream, or even at least about 30 lbs/ream. Still, in one non-limiting embodiment, the abrasive articles can include a normalized weight of abrasive particles of not greater than about 60 lbs/ream, such as not greater than about 50 lbs/ream, or even not greater than about 45 lbs/ream. It will be appreciated that the abrasive articles of the embodiments herein can utilize a normalized weight of shaped abrasive particle within a range between any of the above minimum and maximum values.

According to one embodiment, the coated abrasive article can have an areal density of the abrasive particles within a range between about 90 GSM to about 260 GSM for a range of grit sizes of the abrasive particles within a range of approximately 36 grit to about 120 grit. The foregoing areal density is particularly accurate when using a gravity coating process to deposit the abrasive particles on the backing. In other instances, the areal density of the abrasive particles on the coated abrasive article can be within a range between about 230 GSM to about 370 GSM for abrasive particles having grit sizes within a range from about 36 grit to about 120 grit. The foregoing areal density is particularly accurate when using electrostatic coating processes.

In an embodiment, the abrasive layer 207 can be formed and applied to the backing 202 by forming a mixture including a formulation of one or more coating layers of the abrasive layer (e.g., the make coat 231 and/or size coat 232) and the abrasive particles 209. Processes for combining the abrasive particles with the one or more coating layers can include formation of an abrasive slurry including the abrasive particles 209 and one or more polymer binder materials of the coated layer and/or additives. The abrasive slurry may also include a solvent such as water or an organic solvent. The abrasive slurry can additionally comprise other ingredients, such as organic solvents, thixotropic agents, dual-function materials, crosslinking agents, surfactants, chain transfer agents, stabilizers, dispersants, curing agents, reaction mediators, pigments, dyes, colorants, and fillers. In an embodiment, the slurry can include polymer binder, abrasive particulate material, one or more organic solvents, one or more catalysts, and one or more crosslinking agents. In another embodiment, the abrasive slurry can, optionally, include a surfactant.

Once the slurry is suitably formed, it may be deposited on the backing or one or more intermediate layers. The abrasive slurry containing the abrasive particles and coating layer material can be preferably applied to the backing using a blade spreader to form a coating. Alternatively, the coating process can utilize a die, such as a slot die, smooth rolling, gravure, or reverse gravure coating methods. The coating thickness can range from about 1 to about 5 mils in thickness, after drying. As the backing is fed under the blade spreader at a desired coating speed, the abrasive slurry can be applied to the backing in the desired thickness.

In an alternate embodiment, a coating layer, which can include a mixture of the make coat 231*m* for example, can be first coated onto the backing (or other intervening layers), and the abrasive particles 209 can be placed onto the coating layer through various deposition techniques including, but not limited to, electrostatic attraction (sometimes called "upcoating") or gravity coating process. Both approaches are well understood in the art, generally first depositing a make coat on the backing, followed by deposition of the abrasive particles, and subsequent deposition of a size coat. Optionally, a supersize coat can be deposited over the size coat.

The one or more coating layers may be subject to one or more finishing processes, including but not limited to, curing, irradiation, heating, and the like to facilitate proper formation of the coating layer (e.g., the make coat). It will be appreciated that in other instance, the make coat 231, abrasive particles 209, and size coat 232 can be formed independent of each other, and deposited successively as individual layers. The one or more coating layers can be partially cured or fully cured. Additional molding or forming of the partially cured coating can be performed prior to full curing. In general, the coating layers can be heated to a temperature of between about 100° C. to less than about 250° C. during the curing process. In certain embodiments, it is preferred that the curing step be carried at a temperature of less than about 200° C. Moreover, the process can include partial curing, for example, the make coat and abrasive particles may be deposited over the backing and a partial curing process may be conducted. Thereafter, one or more additional layers, such as a size coat may be formed over the make coat, and then the make coat and additional layers can be completely cured together in a final, total curing process.

The following provides further details on various materials that may be used in the abrasive slurry or other component layers of the coated abrasive articles of the embodiments herein, but is in no way limiting.

Suitable polymer binder materials include polyesters, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and mixtures thereof. A polymer binder mixture can include more than one kind of a polymer resin from a class of polymer resins; for example, a polyester resin can be a mixture of copolyester resins. In an embodiment, a polymer binder may include a co-polyester having a bisphenol moiety in the backbone of the co-polyester. The co-polyester can have less than 50 wt % of the polymer binder, about 50 wt % of the polymer binder, or greater than 50 wt % of the polymer binder.

In an embodiment, the polymer binder may include a single copolyester resin, multiple copolyester resins, or mixtures thereof that have a bisphenol moiety in the backbone of the copolyester resin or resins. In a particular embodiment, the copolyester can be a single copolyester resin having a bisphenol moiety in the backbone of the copolyester resin. In another particular embodiment, the copolyester may be a mixture of two different copolyester resins, one of which has a bisphenol moiety in the backbone of the copolyester resin. In another embodiment, the co-polyester can include a plurality of co-polyesters that each have a bisphenol moiety in their backbones.

In certain instances, the bisphenol moiety in the backbone of the co-polyester can be one of the group consisting of: Bisphenol-A (2,2-Bis(4-hydroxyphenyl)propane), Bisphenol AP (1,1-Bis(4-hydroxyphenyl)-1-phenyl-ethane), Bisphenol-AF (2,2-Bis(4-hydroxyphenyl)hexafluoropropane), Bisphenol-B (2,2-Bis(4-hydroxyphenyl)butane), Bisphenol-BP (Bis-(4-hydroxyphenyl)diphenylmethane), Bisphenol-C (2,2-Bis(3-methyl-4-hydroxyphenyl)propane), Bisphenol-E (1,1-Bis(4-hydroxyphenyl)ethane), Bisphenol-F (Bis(4-hydroxydiphenyl)methane), Bisphenol-G (2,2-Bis(4-hydroxy-3-isopropyl-phenyl)propane), Bisphenol-M (1,3-Bis(2-(4-hydroxyphenyl)-2-propyl)benzene), Bisphenol-S (Bis(4-hydroxyphenyl)sulfone), Bisphenol-P (1,4-Bis(2-(4-hydroxyphenyl)-2-propyl)benzene), Bisphenol-PH (5,5'-(1-Methylethyliden)-bis[1,1'-(bisphenyl)-2-ol]propane), Bisphenol-TMC (1,1-Bis(4-hydroyphenyl)-3,3,5-trimethylcyclohexane), Bisphenol-Z (1,1-Bis(4-hydroxyphenyl)-cyclohexane), and any combinations thereof.

The amount of bisphenol moiety in the backbone of the co-polyester can vary. For example, the amount of bisphenol moiety may be at least 3 wt % to not greater than 75 wt % of the co-polyester backbone.

In an embodiment, the polymer binder can further comprise a polymeric moiety that is cross-linked into the polymeric binder. The polymeric moiety that can be cross-linked into the polymer binder can be: a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novo lac polymer; phenolic/latex polymer; epoxy polymer such as bisphenol epoxy polymer; iso cyanate; isocyanurate; polysiloxane polymer including alkylalkoxysilane polymer; or reactive vinyl polymer. The moiety that is cross-linked into the polymer binder can include a monomer, an oligomer, a polymer, or a combination thereof. The moiety that is cross-linked into the polymer binder can include a polymer system, such as an ultraviolet light (UV) cured polymer system. In an embodiment, the polymer binder can further comprise a polymeric moiety that is cross-linked into the polymeric binder, wherein the polymeric moiety is selected from the group consisting of: bisphenol-A; an epoxy; a phenol formaldehyde; a blocked isocyanate; a urea formaldehyde; a novolac; a resole; a resorcinol-formaldehyde; a UV curable hybrid acrylic epoxy composition; and any combinations thereof.

The polymeric moiety that is cross-linked into the polymeric binder can comprise about 0.5 wt % to about 50 wt % of the total weight of the polymeric binder.

The amount of bisphenol moiety in the polymer binder can vary. The amount of bisphenol moiety is at least 3 wt % to not greater than 75 wt % of the polymer binder.

In an embodiment, the total amount of polymer binder in the abrasive slurry can be at least about 10 wt %, at least about 12 wt %, at least about 13 wt %, at least about 14 wt %, or at least about 15 wt %. In another embodiment, the amount of polymer binder in the abrasive slurry can be not greater than about 20 wt %, not greater than about 19 wt %, not greater than about 18 wt %, or not greater than about 17 wt %. The amount of polymer binder in the abrasive slurry can be within a range comprising any pair of the previous upper and lower limits. In a particular embodiment, the amount of polymer binder included in the abrasive slurry can be in the range of at least about 10 wt % to not greater than about 20 wt %.

In certain aspects, a polyester resin may be utilized in one or more of the component layers of a coated abrasive article of an embodiment. Suitable polyester resins include linear, saturated copolyester resins that can be amorphous and highly-soluble in standard solvents, such as methyl ethyl ketone (2-butanone) (MEK), Toluol, ethyl acetate, and acetone. Alternatively, other suitable polyester resins can be semi-crystalline to crystalline products that have limited solubility and are applied with solvents such as 1,3 Dioxolane or tetrahydrofuran (THF). In an embodiment the polyester resin can be a thermoplastic, high molecular weight, aromatic, linear saturated copolyester resin. For example, Vitel 2210 (Rohm and Haas Company, a wholly owned division of Dow Chemical, Philadelphia, Pa., USA), Skybon ES-120 (SK Chemicals, South Korea or Worthen Industries, Nashua, N.H., USA), or Skybon ES-995 (SK Chemicals, South Korea or Worthen Industries, Nashua, N.H., USA). In an embodiment, the total amount of polyester resin in the abrasive slurry can be at least about 5.0 wt %, at least about 8.0 wt %, or at least about 10 wt %. In another embodiment, the amount of polyester resin in the abrasive slurry can be not greater than about 20 wt %, not greater than about 19 wt %, not greater than about 18 wt %, or not greater than about 17 wt %. The amount of polyester resin in the abrasive slurry can be within a range comprising any pair of the previous upper and lower limits. In a particular embodiment, the amount of polyester resin included in the abrasive slurry can be in the range of at least about 10 wt % to not greater than about 20 wt %, or at least about 10 wt % to not greater than about 18 wt %, or at least about 12 wt % to not greater than about 17 wt %.

In an embodiment, the polymer binder is one of the group consisting of a polyester resin, a copolyester resin, a mixture of more than one copolyester resin, and combinations thereof. In another embodiment, the polymer binder is a single copolyester resin. In a particular embodiment, the polymer binder can be a mixture of two different copolyester resins (i.e., a first copolyester resin and a second copolyester resin). In another embodiment, the first copolyester resin can be a hard resin and the second copolyester resin may be a soft resin. In another embodiment, the ratio of the first copolyester resin to the second copolyester resin may be about 9:1 to about 0.25:1.

Polymer binders of the abrasive slurry can be partially dissolved with solvent (i.e., "diluted") to be more workable and have a particular percent solids range, or viscosity, depending on the application. Suitable organic solvents are those which dissolve the resins of abrasive slurry, such as, for example, ketones, ethers, polar aprotic solvents, esters, aromatic solvents and aliphatic hydrocarbons, both linear and cyclic. Exemplary ketones include methyl ethyl ketone (2-butanone) (MEK), acetone and the like. Exemplary ethers include alkoxyalkyl ethers, such as methoxy methyl ether or ethyl ether, tetrahydrofuran, 1,4 dioxane and the like. Polar aprotic solvents include dimethyl formamide, dimethyl sulfoxide and the like. Suitable esters include alkyl acetates, such as ethyl acetate, methyl 65 acetate and the like. Aromatic solvents include alkylaryl solvents, such as toluene, xylene and the like and halogenated aromatics such as chlorobenzene and the like. Hydrocarbon type solvents include, for example, hexane, cyclohexane and the like. A preferred organic solvent is methyl ethyl ketone. In an embodiment, the amount of organic solvent in the abrasive slurry can be at least about 5.0 wt %, at least about 6.0 wt %, at least about 7.0 wt %, or at least about 8.0 wt %. In another embodiment, the amount of organic solvent in the abrasive slurry can be not greater than about 68 wt %, not greater than about 67 wt %, not greater than about 66 wt %, not greater than about 65 wt %, or not greater than about 64 wt %. The amount of organic solvent in the abrasive slurry can be within a range comprising any pair of the previous upper and lower limits. In a particular embodiment, the amount of organic solvent included in the abrasive slurry can be in the range of at least about 5.0 wt % to not greater than about 68 wt %.

Suitable surfactants are those that have a low solubility in water and that have amphipathic properties. In an embodiment, lecithin is a surfactant. In an embodiment, the amount of surfactant in the abrasive slurry or any of the other component layers of a coated abrasive article described herein can be at least about 0.1 wt %, at least about 0.125 wt %, or at least about 0.15 wt %. In another embodiment, the amount of surfactant in the abrasive slurry can be not greater than about 0.5 wt %, not greater than about 0.4 wt %, not greater than about 0.375 wt %, or not greater than about 0.35 wt %. The amount of surfactant in the abrasive slurry can be within a range comprising any pair of the previous upper and lower limits. In a particular embodiment, the amount of surfactant included in the abrasive slurry can be in the range of at least about 0.1 wt % to not greater than about 0.5 wt %.

Suitable catalyst agents (i.e., catalysts) can be materials that promote polymeric reactions. In an embodiment, the catalyst can be an amine neutralized mixture of sulfonic acids. In another embodiment, the catalyst can be a tetravalent diorganotin. More than one type of catalyst or mixtures of catalyst can be used in the abrasive slurry mixture or any of the other component layers of a coated abrasive article described herein. In an embodiment, the amount of catalyst in the abrasive slurry can be at least about 0.01 wt %, at least about 0.015 wt %, or at least about 0.0175 wt %. In another embodiment, the amount of catalyst in the abrasive slurry (or any component layer) can be not greater than about 0.04 wt %, not greater than about 0.0375 wt %, not greater than about 0.035 wt %, or not greater than about 0.0325 wt %. The amount of catalyst in the abrasive slurry can be within a range comprising any pair of the previous upper and lower limits. In a particular embodiment, the amount of catalyst included in the abrasive slurry can be in the range of at least about 0.01 wt % to not greater than about 0.04 wt %.

Suitable cross-linking agents are those that promote cross-linking of the polymer binder materials in the abrasive slurry. Notably, the crosslinking agent may promote cross-linking of polyester resin, or epoxy resin, or combinations thereof. The crosslinking agents of the abrasive slurry or any of the other component layers of a coated abrasive article described herein can be isocyanates, including polyisocyanates. In another embodiment, crosslinking agents can be a methylated melamine. In an embodiment, the amount of cross-linking agent in the abrasive slurry or any of the other component layers of a coated abrasive article described herein can be at least about 0.2 wt %, at least about 0.3 wt %, or at least about 0.4 wt %. In another embodiment, the amount of cross-linking agent in the abrasive slurry can be not greater than about 1.0 wt %, not greater than about 0.8 wt %, or not greater than about 0.7 wt %. The amount of cross-linking agent in the abrasive slurry or any of the other component layers of a coated abrasive article described herein can be within a range comprising any pair of the previous upper and lower limits. In a particular embodiment, the amount of cross-linking agent included in the abrasive slurry can be in the range of at least about 0.1 wt % to not greater than about 1.0 wt %.

Figure 7:
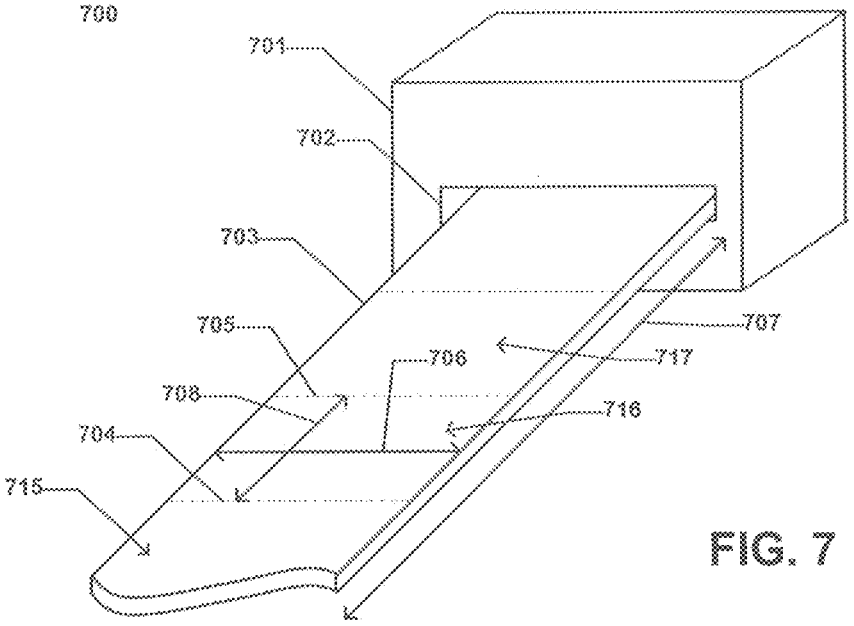
FIG. 7 includes an illustration of a system for dispensing a coated abrasive article according to an embodiment.

FIG. 7 includes an illustration of a system for dispensing a coated abrasive article according to an embodiment. In one particular aspect, the system 700 can include a dispenser 701 having an opening 702. The system 700 can further include a coated abrasive article 703 contained within the dispenser 701, and configured to be dispensed by a user from the dispenser 701 through the opening 702. The coated abrasive article 703 can include any of the features of the coated abrasive articles of the embodiments. Moreover, the coated abrasive article 703 can be in the form of a roll contained within the dispenser 701 and configured to be extracted from the dispenser 701 as a single sheet.

In one particular instance, the coated abrasive article 703 can include a first set of perforations 704. The first set of perforations 704 can facilitate selective sizing of portions of the coated abrasive article 703. For example, a user may extract a desired amount of the coated abrasive article 703 from the dispenser 701 and tear the coated abrasive article 703 to a suitable size for a task. In particular, if a user desired to separate the portion 715 of the coated abrasive article 703 from the portion 716 of the coated abrasive article, the user could tear the portion 715 from the portion 716 at the first set of perforations 704. Accordingly, the coated abrasive article 703 can be configured to be dispensed in a size-selective manner, and the first set of perforations 704 can enable a user to select from various sizes of portions of the coated abrasive article.

According to one embodiment, the first set of perforations 704 can extend in a substantially linear path in the direction of the lateral axis 706 of the body of the coated abrasive article 703. As generally illustrated, for the coated abrasive article 703 having a generally sheet-like shape, the length can define the longest dimension of the body extending in the direction of the longitudinal axis 707. The width of the body of the sheet-like coated abrasive article 703 can define a second longest dimension extending in a lateral axis 706 that extends in a direction substantially perpendicular to the length and longitudinal axis 707. Moreover, the first set of perforations 704 can extend in a linear path that defines a perforation axis that can be substantially parallel to the lateral axis 706 of the body of the coated abrasive article 703. The first set of perforations 704 can define a perforation axis extending laterally across the body. Moreover, in certain embodiments, such as illustrated in FIG. 7, the first set of perforations 704 can extend along an entire width of the coated abrasive article 703, and more particularly, across an entire width of the backing of the coated abrasive article 703. Still, it will be appreciated that the first set of perforations 704 need not extend in a linear path. For instance, it is contemplated, that the first set of perforations 704 can extend in a non-linear path, including for example, but not limited to, an arcuate path.

As further illustrated, the coated abrasive article 703 can include a second set of perforations 705. The second set of perforations 705 can facilitate selective sizing of portions of the coated abrasive article 703. In particular, if a user desired to separate the portion 716 of the coated abrasive article 703 from the portion 717 of the coated abrasive article, the user could tear the portion 715 from the portion 717 at the second set of perforations 705. Accordingly, the coated abrasive article 703 can be configured to be dispensed in a size-selective manner, and the second set of perforations 705 can enable a user to select from various sizes of portions of the coated abrasive article.

According to one embodiment, the second set of perforations 705 can extend in a substantially linear path in the direction of the lateral axis 706 of the body of the coated abrasive article 703. Moreover, the second set of perforations 705 can extend in a linear path that defines a perforation axis that can be substantially parallel to the lateral axis 706 of the body of the coated abrasive article 703. The second set of perforations 705 can define a perforation axis extending laterally across the body. Moreover, in certain embodiments, such as illustrated in FIG. 7, the second set of perforations 705 can extend along an entire width of the coated abrasive article 703, and more particularly, across an entire width of the backing of the coated abrasive article 703. Still, it will be appreciated that the second set of perforations 705 need not extend in a linear path. For instance, it is contemplated, that the second set of perforations 705 can extend in a non-linear path, including for example, but not limited to, an arcuate path.

Additionally, the second set of perforations 705 can be separated from the first set of perforations 704 by a longitudinal distance 708. The longitudinal distance may determine the size of the portions (e.g., portion 716) between the first set of protrusions 704 and the second set of protrusions 705. It will be appreciated that various suitable dimensions for the longitudinal distance 708 may be utilized based on the intended application of the coated abrasive article and the users specifications.

Figure 8:
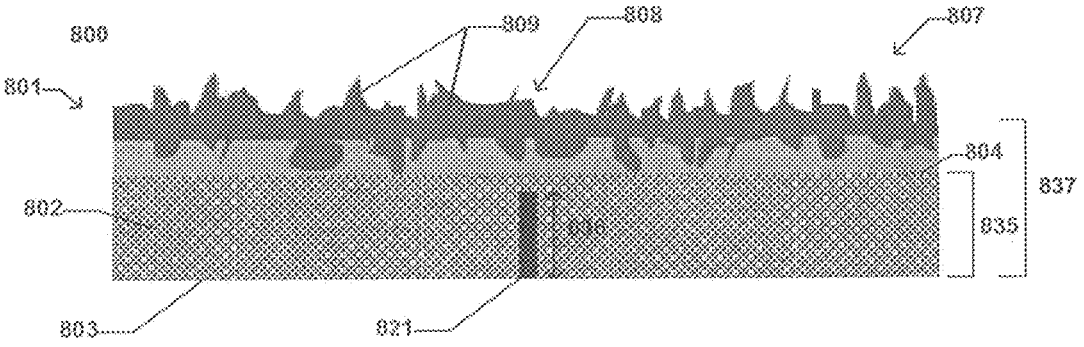
FIG. 8 includes a cross-sectional illustration of a portion of a coated abrasive article in accordance with an embodiment.

For further clarity in reference to the embodiment of FIG. 7, FIG. 8 includes a cross-sectional illustration of a portion of a coated abrasive article in accordance with an embodiment. As illustrated, FIG. 8 includes a coated abrasive article 800 having a body 801. The body 801 can include a backing 802, including an upper major surface 804, and a lower major surface 803 opposite the upper major surface 804. Moreover, the body 801 can include an abrasive layer 807 overlying the backing 802, and more particularly, overlying the upper major surface 804 of the backing 802. The abrasive layer 807 can include abrasive particles 809, and at least one adhesive layer 808 configured to couple and bond the abrasive particles 809 to the backing 802.

As further illustrated in FIG. 8, the body 801 of the coated abrasive article 800 can include a perforation 821. The perforation 821 can be a single perforation in a set of perforations, such as the first set of perforations 704 and/or second set of perforations 705, where all of the perforations of the set may have the same attributes as the perforation 821. As illustrated, the perforation 821, and thus the set of perforations associated with the perforation 821 (e.g., the first set of perforations 704 and/or the second set of perforation 705) can intersect the lower major surface 803 of the backing 802 and extend into a thickness (835) of the backing 802. In particular instances, the perforation 821, and thus the set of perforations associated with the perforation 821 (e.g., the first set of perforations 704 and/or the second set of perforation 705) can have a particular average depth 836 with respect to certain layers and thicknesses of certain component layers of the body 801 of the coated abrasive article 800. Notably, it will be appreciated, that while FIG. 8 demonstrates a perforation 821 having a particular average depth 836, other perforations and other sets of perforations can have other suitable depths to facilitate effective sectioning of the coated abrasive article 800.

For example, in one embodiment, the perforation 821, and thus the set of perforations associated with the perforation 821 (e.g., the first set of perforations 704 and/or the second set of perforation 705) can have an average depth 836 that at least a portion of a thickness 835 of the backing 802. Note that reference to a thickness 835 of the backing 802 can be reference to an average thickness. According to one particular embodiment, the perforation 821, and thus the set of perforations associated with the perforation 821 (e.g., the first set of perforations 704 and/or the second set of perforation 705) can have an average depth 836 that extends through an entire thickness of the backing 802, such that the perforation 821 intersect the lower major surface 803 and upper major surface 804 of the backing.

Moreover, in one embodiment, the perforation 821, and thus the set of perforations associated with the perforation 821 (e.g., the first set of perforations 704 and/or the second set of perforation 705), can have an average depth 836 that is at least a portion of a thickness 837 of the body 801 of the coated abrasive article 800 including the backing 802 and the abrasive layer 807. For example, in one instance, the perforation 821, and thus the set of perforations associated with the perforation 821 (e.g., the first set of perforations 704 and/or the second set of perforation 705), can have an average depth 836 extending from the lower major surface 803 of the backing 802 and into the abrasive layer 807. According to one particular embodiment, the perforation 821, and thus the set of perforations associated with the perforation 821 (e.g., the first set of perforations 704 and/or the second set of perforation 705), can have an average depth 836 that extends for essentially the entire thickness 837 of the body 801, such that the perforation can extend entirely through the body 801 of the coated abrasive article 800 including the backing 802 and the abrasive layer 807.

Notably, it will be appreciated, that the perforation can extend through any component layers of the embodiments herein, including but not limited to a backfill layer, a frontfill layer, an intermediate layer, a make coat layer, a size coat layer, and the like. Moreover, any of the features of the perforation 821 can be attributed to the first set of perforations 704, second set of perforations 705, and any set of perforations of the coated abrasive articles of the embodiments herein.

EXAMPLES

Example 1

Figure 3:
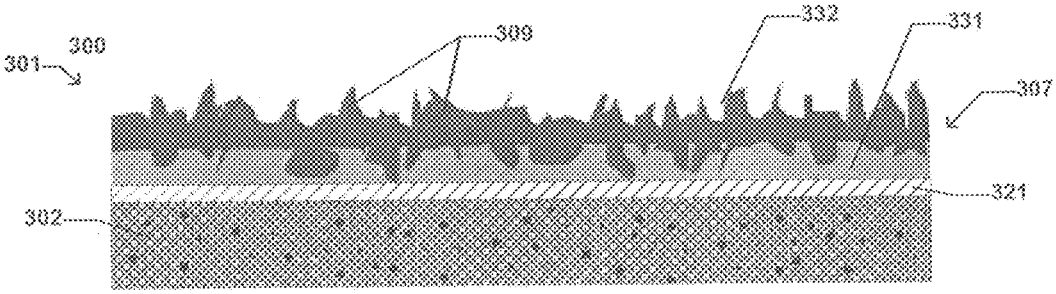
FIG. 3 includes a cross-sectional illustration of a portion of a coated abrasive article in accordance with an embodiment.

A first coated abrasive article was formed having the construction provided in Table 1 below, and as generally illustrated in FIG. 3. Notably, the coated abrasive article 300 includes a body 301, which includes a backing 302 including a non-woven material and a saturant contained within the porosity of the non-woven material, a frontfill layer 321 overlying the backing 302, and abrasive layer including a make coat 331, abrasive particles 309, and a size coat 332 overlying the frontfill layer 321 and the backing 302. The non-woven backing material was a spunlace polyester material, having a major upper surface having an average surface roughness of about 9 microns, an average machine-direction stiffness of about 140 MPa, an average cross-direction stiffness of approximately 16 MPa, an average machine direction shear modulus of approximately 51 MPa, and an average cross-direction shear modulus of approximately 6 MPa. The spunlace polyester material was subject to a saturation process of dipping the non-woven backing in the saturant formulation of approximately 99% of urea-formaldehyde resin and 1% of catalyst followed by a controlled heating process to conduct curing of the saturant. The controlled heating process utilized a gradual increase in temperature from approximately 100° C. to a final cure temperature of approximately 140° C.-160° C. The saturant had an areal density of approximately 60 GSM.

The backing including the spunlace polyester material and the saturant had an average machine-direction stiffness of about 300 MPa, an average cross-direction stiffness of approximately 20 MPa, an average machine direction shear modulus of approximately 110 MPa, and an average cross-direction shear modulus of approximately 7 MPa. Moreover, the backing including the spunlace polyester material and the saturant had an air porosity value of approximately 4 sec/100 cc, and a water absorption value of approximately 22%.

A frontfill layer 321 was formed on the backing using a process where the formulation was coated at a viscosity of about 2000 cps (measured using Brookfield viscometer) at room temperature using a two roll coater at a run speed of 35 meters per minutes on the smoother side of the backing. The backing with the frontfill is then cured using a controlled heating process including a gradual heating of the components from approximately 100° C. to a final cure temperature of approximately 150° C.-170° C.

For ease of reference, the materials referenced in Table 2 include the following materials from the manufacturers as indicated. The phenolic resin is commercially available as LTR phenolic resin and the urea formaldehyde resin is commercially available as Wescamine M from West Coast Polymer. The iron oxide is available as Red Oxide Liquid—TATA T110 from Vinayak Auxi Chem. The abrasive particles are alumina, which are available from Futon Imp. & Exp. Inc. The calcium carbonate material is available as CFL DURA from Mahaveer Chemicals or Kirti. The thickener is available as ASE 60 from Mahalaskhmi Chemicals or Indofil. The acrylic resin is available as TR407 from Rohm and Haas. The Grey Dye is available by name from Amritlal Chemix. The catalyst is available as AMP 700 from Sri Gur Udeva Dutta Scientific.

An abrasive layer was formed on the backing and front fill layer, which included a make coat, abrasive particles, and a size coat layer. The abrasive layer was formed using a process including the following steps where in the make coat is deposited on the front fill and abrasive particles are deposited on the make coat. The make coat is subject to a partial cure, such that it undergoes a controlled heating process to facilitate partial curing of the make coat formulation. A size coat is then provided on the make coat, and the make coat and size coat are subject to a final curing, wherein the make coat and size coat undergo a controlled heating process to facilitate complete curing, Generally, curing is conducted in a manner as described in accordance with the curing of the front fill material.

TABLE 1

| | | |
|---|---|---|
| Backing | Spunlace polyester (approximately 100-200 GSM) | |
| | Saturant of urea formaldehyde and approximately 1 wt % Catalyst-700 | |
| Frontfill | Acrylic resin | ~35% |
| | Calcium carbonate | ~43% |
| | Thickener | ~1% |
| | Phenolic Resin | ~21% |
| Make Coat | Phenolic resin | ~41% |
| | Acrylic resin | ~4% |
| | Calcium carbonate | ~54% |
| | Iron Oxide | ~1% |
| Abrasive Particles | Alumina | |
| Size Coat | Phenolic resin | ~47% |
| | Acrylic resin | ~5% |
| | Calcium Carbonate | ~47% |
| | Iron Oxide | ~2% |

Example 2

Figure 4:
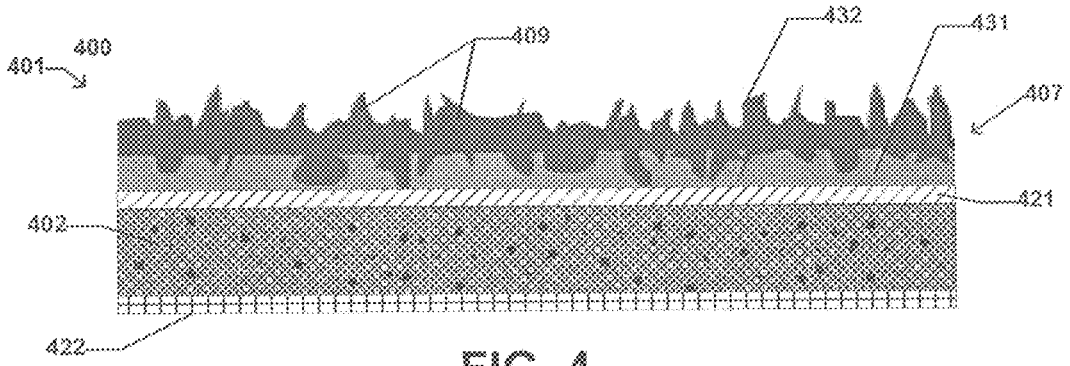
FIG. 4 includes a cross-sectional illustration of a portion of a coated abrasive article in accordance with an embodiment.

A second coated abrasive article was formed having the construction provided in Table 2 below, and as generally illustrated in FIG. 4. Notably, the coated abrasive article 400 includes a body 401, which includes a backing 402 including a non-woven material, a frontfill layer 421 overlying the backing 302, a backfill layer underlying the backing 402, and abrasive layer 407 including a make coat 431, abrasive particles 409, and a size coat 432 overlying the frontfill layer 421, the backing 402 and backfill layer 422. The non-woven backing material was the same spunlace material as used in Example 1, with the addition of an extruded polyolefin (polyethylene or polypropylene) layer extruded on one side of the spunlace polyester material as the backfill layer 422.

The backing including the spunlace polyester material and the polyolefin backfill layer 402 had an average machine-direction stiffness of about 300 MPa, an average cross-direction stiffness of approximately 20 MPa, an average machine direction shear modulus of approximately 110 MPa, and an average cross-direction shear modulus of approximately 7 MPa. Moreover, the backing including the spunlace polyester material and the saturant had an air porosity value of approximately 26 sect/100 cc, and a water absorption value of approximately 27%. The frontfill layer 421 and abrasive layer 407 were formed on the backing 402 using the same process as detailed in Example 1.

TABLE 2

| | | |
|---|---|---|
| Backing | Spunlace polyester (approximately 100-200 GSM) | |
| Frontfill | Acrylic resin | ~35% |
| | Calcium carbonate | ~43% |
| | Thickener | ~1% |
| | Phenolic Resin | ~21% |
| Backfill | HDPE | ~100% |
| Make Coat | Phenolic resin | ~41% |
| | Acrylic resin | ~4% |
| | Calcium carbonate | ~54% |
| | Iron Oxide | ~13% |
| Abrasive Particles | Alumina | |
| Size Coat | Phenolic resin | ~47% |
| | Acrylic resin | ~5% |
| | Cab Dura | ~47% |
| | Red Oxide | ~2% |

Example 3

A third coated abrasive article was formed having the construction provided in Table 3 below, and as generally illustrated in FIG. 2. Notably, the coated abrasive article 200 includes a body 201, which includes a backing 202 including a non-woven material and a saturant contained within the porosity of the non-woven material, a frontfill layer 221 overlying the backing 202, an intermediate layer 225 of cotton cloth having an areal density of approximately 50-150 GSM, and an abrasive layer 207 including a make coat 231, abrasive particles 209, and a size coat 232 overlying the intermediate layer 225, frontfill layer 221, and the backing 202. The non-woven backing material was the same spunlace material as used in Example 1 and was saturated with a saturant in the same manner as described in Example 1.

TABLE 3

| | | |
|---|---|---|
| Backing | Spunlace polyester (approximately 100-200 GSM) | |
| | Saturant of urea formaldehyde and approximately 1 wt % catalyst | |
| Frontfill | Acrylic resin | ~35% |
| | Calcium carbonate | ~43% |
| | Thickener | ~1% |
| | Phenolic Resin | ~21% |
| Intermediate Layer | Woven cotton cloth with 50GSM | |
| Make Coat | Phenolic resin | ~41% |
| | Acrylic resin | ~4% |
| | Calcium carbonate | ~54% |
| | Iron Oxide | ~1% |
| Abrasive Particles | Alumina | |

TABLE 3-continued

| | | |
|---|---|---|
| Size Coat | Phenolic resin | ~47% |
| | Acrylic resin | ~5% |
| | Calcium carbonate | ~47% |
| | Iron Oxide | ~2% |

The backing 202 including the spunlace polyester material and the saturant had an average machine-direction stiffness of about 300 MPa, an average cross-direction stiffness of approximately 20 MPa, an average machine direction shear modulus of approximately 110 MPa, and an average cross-direction shear modulus of approximately 7 MPa. Moreover, the backing 202 including the spunlace polyester material and the saturant had an air porosity value of approximately 1 sec/100 cc, and a water absorption value of approximately 26%.

The frontfill layer 221 and abrasive layer 207 were formed on the backing 402 using the same process as detailed in Example 1.

The intermediate layer 225 was formed on the frontfill layer 221 using a lamination process with a hot melt ethylene vinyl acetate (EVA) adhesive.

Conventional Example

Figure 5:
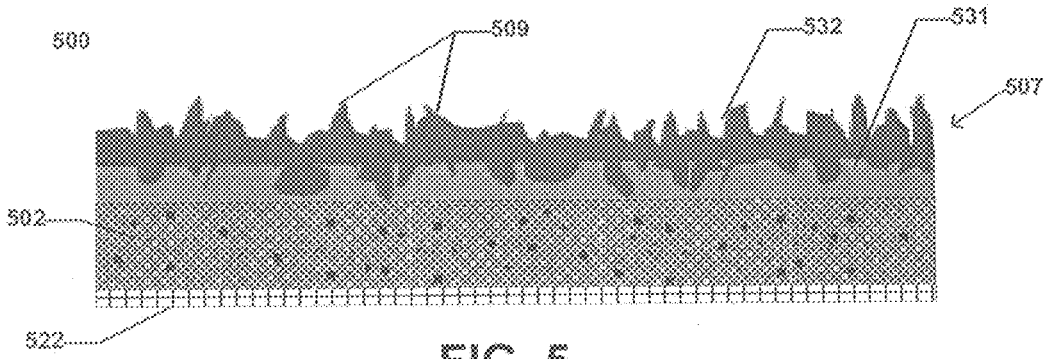
FIG. 5 includes a cross-sectional illustration of a portion of a conventional coated abrasive article.
Figure 6:
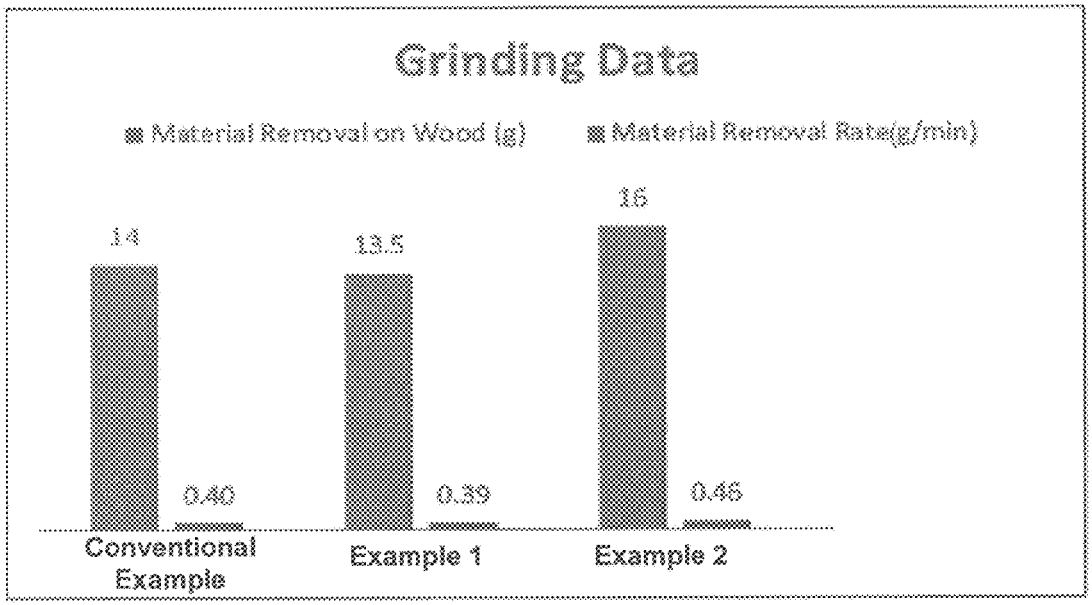
FIG. 6 includes a plot of material removal and material removal rate for examples representing coated abrasive articles of embodiments herein compared to a conventional product.

A conventional coated abrasive article sample was obtained from Grindwell Norton as Sand it all. Notably, the coated abrasive article 500 has a structure as shown in FIG. 5, which includes a body 501 including a backing 502 comprising a woven material of cotton finished by saturation, a backfill layer 522 underlying the backing 502, and abrasive layer 507 including a make coat 531, abrasive particles 509, and a size coat 532 overlying the, the backing 502 and backfill layer 522. The formulations of the saturant and backfill are provided in Table 4 below. The formulations of the make coat and size coat are essentially the same as provided in Table 1.

TABLE 4

| | |
|---|---|
| Saturant | |
| Acrylic resin | 47.3% |
| Phenolic resin | 52.0% |
| Grey Dye | 0.2% |
| Catalyst | 0.5% |
| Back Fill | |
| Urea formaldehyde resin | 33.1% |
| Calcium carbonate | 33.1% |
| Grey Dye | 0.1% |
| Catalyst | 0.5% |
| Acrylic resin | 33.1% |

FIG. 5 includes a plot of material removal and material removal rate for examples representing coated abrasive articles of embodiments herein compared to a conventional product. The samples were tested according to the procedures as provided in Table 5 below. As illustrated, despite Examples 1 and 2 using a non-woven backing material, which would normally result in lower material removal and lower material removal rates, quite remarkably and unexpectedly, the exemplary embodiments (i.e., Examples 1 and 2) demonstrated equal or better improvement relative to the standard product utilizing a woven backing material. In fact, Example 1 demonstrated it performed as well as the conventional woven product. Even more remarkable, Example 2 demonstrated improved performance compared to the Conventional Example including the woven backing.

TABLE 5

| | |
|---|---|
| Step 1 | Take a Babbol/Teak wood plank of dimension 150 mm × 700 mm × 25 mm as received from saw mill |
| Step 2 | Remove off any roughage and projections on the surface. |
| Step 3 | Blow off the dust with low air |
| Step 4 | Cut the coated abrasive sample sheet in ¼ size |
| Step 5 | Take Initial weight of sheet |
| Step 6 | Fold the cut sheet around a dual density pad/wooden block |
| Step 7 | Take the initial weight of the plank |
| Step 8 | Hold the sheet wrapped round the pad and Start sanding on the plank(half length) |
| Step 9 | Observe while sanding for grain shedding for the first 2 minutes |
| Step 10 | Complete sanding for 5 minutes |
| Step 11 | Blow off the dust on the plank with low pressure AIR |
| Step 12 | Take the weight of the plank, coated abrasive sample sheet and record the MR |
| Step 13 | Continue sanding in intervals of 5 mins and take weights of plank and sheet |
| Step 14 | Conclude sanding once the material removal(MR) has reached less than 1 gram |
| Step 15 | Repeat sanding for 2 more readings of MR to confirm the end of life. |
| Step 16 | Now visually observe the sheet for failure modes along with microscopic observations |
| Step 17 | Record all observations noted during the entire sanding operation WRT stiffness, cut rate and grip while sanding |

The foregoing embodiments represent a departure from the state of the art. While spunlace materials have been suggested as possible materials to be used in coated abrasives, such materials are typically not employed as a backing material. In the instances where spunlace materials are used in the backing, the performance is typically not comparable to coated abrasive articles using woven backing materials, and thus has not been adapted technically or commercially. The foregoing embodiments include a combination of features, including but not limited to, particular non-woven materials having certain compositions and properties, certain finishing processes including saturation of the non-woven material, various constructions including suitable combinations of component layers such as a backfill layer, frontfill layer, intermediate layer, make coat, size coat and the like. Without wishing to be tied to a particular theory, the inventors of the present application found it quite remarkable that the coated abrasive articles of the embodiments herein demonstrated superior performance compared to other, conventional coated abrasive articles including non-woven backing materials, and even more remarkable that the performance for the coated abrasive articles of the embodiments herein demonstrated equal or better performance compared to coated abrasive articles using woven backing materials.

The foregoing description of embodiments for this invention has been presented for purposes of illustration and description. It is not intended to be exhaustive or to limit the invention to the precise form disclosed. Modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

Item 1. A coated abrasive article comprising: a body including: a backing including a spunlace polyester-based material and a saturant contained in the spunlace polyester-based material, wherein the saturant comprises a material selected from the group comprising of phenolic resin, acrylic, urea resin, and a combination thereof; and an abrasive layer overlying the backing including abrasive particles.

Item 2. A coated abrasive article comprising: a body including: a backing including a spunlace polyester-based material and a saturant contained in the spunlace polyester-based material, wherein the spunlace polyester-based material comprises an areal density of at least about 50 grams per square meter (GSM) and not greater than about 300 grams per square meter (GSM), and an abrasive layer overlying the backing including abrasive particles.

Item 3. A coated abrasive article comprising: a body including: a backing including a non-woven material having a machine-direction stiffness of at least about 80 MPa and not greater than about 220 MPa, and a cross-direction stiffness of at least about at least about 1 MPa and not greater than about 40 MPa, wherein the backing further comprises a saturant contained within the non-woven material; and an abrasive layer overlying the backing including abrasive particles.

Item 4. The coated abrasive article of item 1, wherein the spunlace polyester-based material of the backing comprises an areal density of at least about 50 grams per square meter (GSM), at least about 60 GSM, at least about 70 GSM, at least about 80 GSM, at least about 90 GSM, at least about 100 GSM, at least about 110 GSM, at least about 120 GSM, at least about 130 GSM, at least about 140 GSM, at least about 150 GSM.

Item 5. The coated abrasive article of item 1, wherein the spunlace polyester-based material of the backing comprises an areal density of not greater than about 300 grams per square meter (GSM), not greater than about 290 GSM, not greater than about 280 GSM, not greater than about 270 GSM, not greater than about 260 GSM, not greater than about 250 GSM.

Item 6. The coated abrasive article of item 2, wherein the spunlace polyester-based material of the backing comprises an areal density of at least about 60 GSM, at least about 70 GSM, at least about 80 GSM, at least about 90 GSM, at least about 100 GSM, at least about 110 GSM, at least about 120 GSM, at least about 130 GSM, at least about 140 GSM, at least about 150 GSM, and wherein the spunlace polyester-based material of the backing comprises an areal density of not greater than about 290 GSM, not greater than about 280 GSM, not greater than about 270 GSM, not greater than about 260 GSM, not greater than about 250 GSM.

Item 7. The coated abrasive article of item 3, wherein the non-woven material of the backing comprises an areal density of at least about 50 GSM at least about 60 GSM, at least about 70 GSM, at least about 80 GSM, at least about 90 GSM, at least about 100 GSM, at least about 110 GSM, at least about 120 GSM, at least about 130 GSM, at least about 140 GSM, at least about 150 GSM, and wherein the non-woven material of the backing comprises an areal density of not greater than about 290 GSM, not greater than about 280 GSM, not greater than about 270 GSM, not greater than about 260 GSM, not greater than about 250 GSM.

Item 8. The coated abrasive article of any one of items 1 and 2, wherein the spunlace polyester-based material comprises an average thickness of not greater than about 10 mm, not greater than about 9 mm, not greater than about 8 mm, not greater than about 7 mm, not greater than about 6 mm, not greater than about 5 mm, not greater than about 4 mm, not greater than about 3 mm, not greater than about 2 mm, not greater than about 1 mm, and wherein the spunlace polyester-based material comprises an average thickness of at least about 0.05 mm, at least about 0.08 mm, at least about 0.1 mm, at least about 0.2 mm, at least about 0.3 mm, at least about 0.5 mm.

Item 9. The coated abrasive article of item 3, wherein the non-woven material comprises an average thickness of not greater than about 10 mm, not greater than about 9 mm, not greater than about 8 mm, not greater than about 7 mm, not greater than about 6 mm, not greater than about 5 mm, not greater than about 4 mm, not greater than about 3 mm, not greater than about 2 mm, not greater than about 1 mm, and wherein the non-woven material comprises an average thickness of at least about 0.05 mm, at least about 0.08 mm, at least about 0.1 mm, at least about 0.2 mm, at least about 0.3 mm, at least about 0.5 mm.

Item 10. The coated abrasive article of any one of items 1, 2, and 3, wherein the backing comprises an average thickness of not greater than about 10 mm, not greater than about 9 mm, not greater than about 8 mm, not greater than about 7 mm, not greater than about 6 mm, not greater than about 5 mm, not greater than about 4 mm, not greater than about 3 mm, not greater than about 2 mm, not greater than about 1 mm, and wherein the backing comprises an average thickness of at least about 0.05 mm, at least about 0.08 mm, at least about 0.1 mm, at least about 0.2 mm, at least about 0.3 mm, at least about 0.5 mm.

Item 11. The coated abrasive article of any one of items 1, 2, and 3, wherein the backing comprises a generally planar upper major surface, wherein the upper major surface comprises an average surface roughness (Ra) of not greater than about 20 microns, not greater than about 18 microns, not greater than about 15 microns, not greater than about 12 microns, not greater than about 10 microns, and wherein the upper major surface comprises an average surface roughness (Ra) of at least about 1 micron.

Item 12. The coated abrasive article of any one of items 1, 2, and 3, wherein the backing comprises a generally planar lower major surface, wherein the lower major surface comprises an average surface roughness (Ra) of not greater than about 30 microns, not greater than about 28 microns, not greater than about 25 microns, not greater than about 22 microns, not greater than about 20 microns, not greater than about 18 microns, and wherein the upper major surface comprises an average surface roughness (Ra) of at least about 5 microns.

Item 13. The coated abrasive article of any one of items 1, 2, and 3, wherein the backing comprises a generally planar and uncorregated contour.

Item 14. The coated abrasive article of any one of items 1, 2, and 3, wherein the backing comprises a machine-direction stiffness of at least about 200 MPa, at least about 210 MPa, at least about 220 MPa, at least about 230 MPa, at least about 240 MPa, at least about 250 MPa, at least about 260 MPa, at least about 270 MPa, at least about 280 MPa, at least about 290 MPa, and wherein the backing comprises a machine-direction stiffness of not greater than about 400 MPa, not greater than about 390 MPa, not greater than about 380 MPa, not greater than about 370 MPa, not greater than about 360 MPa, not greater than about 350 MPa.

Item 15. The coated abrasive article of any one of items 1, 2, and 3, wherein the backing comprises a cross-direction stiffness of at least about 1 MPa, at least about 2 MPa, at least about 3 MPa, at least about 4 MPa, at least about 5 MPa, at least about 6 MPa, at least about 7 MPa, at least about 8 MPa at least about 10 MPa, and wherein the backing comprises a cross-direction stiffness of not greater than about 50 MPa, not greater than about 45 MPa, not greater than about 40 MPa, not greater than about 38 MPa, not greater than about 35 MPa, not greater than about 33 MPa.

Item 16. The coated abrasive article of any one of items 1 and 2, wherein the spunlace polyester-based material of the backing comprises a machine-direction stiffness of at least about 80 MPa, at least about 90 MPa, at least about 100 MPa, at least about 110 MPa, at least about 120 MPa, and wherein the spunlace polyester-based material of the backing comprises a machine-direction stiffness of not greater than about 220 MPa, not greater than about 210 MPa, not greater than about 200 MPa, not greater than about 190 MPa, not greater than about 180 MPa, not greater than about 160 MPa.

Item 17. The coated abrasive article of any one of items 1 and 2, wherein the spunlace polyester-based material of the backing comprises a cross-direction stiffness of at least about at least about 1 MPa, at least about 2 MPa, at least about 3 MPa, at least about 5 MPa, at least about 8 MPa, and wherein the spunlace polyester-based material of the backing comprises a cross-direction stiffness of not greater than about 40 MPa, not greater than about 38 MPa, not greater than about 35 MPa, not greater than about 33 MPa, not greater than about 30 MPa, not greater than about 28 MPa.

Item 18. The coated abrasive article of item 3, wherein the non-woven material of the backing comprises a machine-direction stiffness of at least about 90 MPa, at least about 100 MPa, at least about 110 MPa, at least about 120 MPa, and wherein the spunlace polyester-based material of the backing comprises a machine-direction stiffness of not greater than about 210 MPa, not greater than about 200 MPa, not greater than about 190 MPa, not greater than about 180 MPa, not greater than about 160 MPa.

Item 19. The coated abrasive article of item 3, wherein the non-woven material of the backing comprises a cross-direction stiffness of at least about at least about 2 MPa, at least about 3 MPa, at least about 5 MPa, at least about 8 MPa, and wherein the spunlace polyester-based material of the backing comprises a cross-direction stiffness of not greater than about 38 MPa, not greater than about 35 MPa, not greater than about 33 MPa, not greater than about 30 MPa, not greater than about 28 MPa.

Item 20. The coated abrasive article of any one of items 1 and 2, wherein the spunlace polyester-based material comprises a porosity of not greater than about 25 vol % for a total volume of the backing, wherein the porosity of the spunlace polyester-based material is not greater than about 20 vol %, not greater than about 15 vol %, not greater than about 12 vol %, not greater than about 10 vol %, not greater than about 8 vol %, not greater than about 6 vol %, not greater than about 4 vol %, and wherein the spunlace polyester-based material of the backing comprises a porosity of at least about 1 vol %, at least about 2 vol %, at least about 4 vol %, at least about 6 vol %, at least about 8 vol %, at least about 10 vol %.

Item 21. The coated abrasive article of item 3, wherein the non-woven material comprises a porosity of not greater than about 25 vol % for a total volume of the backing, wherein the porosity of the non-woven material is not greater than about 20 vol %, not greater than about 15 vol %, not greater than about 12 vol %, not greater than about 10 vol %, not greater than about 8 vol %, not greater than about 6 vol %, not greater than about 4 vol %, and wherein the spunlace polyester-based material of the backing comprises a porosity of at least about 1 vol %, at least about 2 vol %, at least about 4 vol %, at least about 6 vol %, at least about 8 vol %, at least about 10 vol %.

Item 22. The coated abrasive article of any one of items 1 and 2, wherein the backing comprises a saturant/backing content ratio (Cs/Cb) of not greater than about 1, wherein Cs represents a weight percent of the saturant for a total weight of the backing, and Cb represents a weight percent of spunlace polyester-based material of the backing for a total weight of the backing, wherein the saturant/backing content ratio (Cs/Cb) is not greater than about 0.9, not greater than about 0.8, not greater than about 0.7, not greater than about 0.6, not greater than about 0.5, not greater than about 0.4, not greater than about 0.35, not greater than about 0.3, not greater than about 0.25, not greater than about 0.2, not greater than about 0.15, not greater than about 0.1, not greater than about 0.08, and wherein the saturant/backing content ratio (Cs/Cb) is at least about 0.01, at least about 0.02, at least about 0.03, at least about 0.05, at least about 0.08, at least about 0.1.

Item 23. The coated abrasive article of item 3, wherein the backing comprises a saturant/backing content ratio (Cs/Cb) of not greater than about 1, wherein Cs represents a weight percent of the saturant for a total weight of the backing, and Cb represents a weight percent of the non-woven material of the backing for a total weight of the backing, wherein the saturant/backing content ratio (Cs/Cb) is not greater than about 0.9, not greater than about 0.8, not greater than about 0.7, not greater than about 0.6, not greater than about 0.5, not greater than about 0.4, not greater than about 0.35, not greater than about 0.3, not greater than about 0.25, not greater than about 0.2, not greater than about 0.15, not greater than about 0.1, not greater than about 0.08, and wherein the saturant/backing content ratio (Cs/Cb) is at least about 0.01, at least about 0.02, at least about 0.03, at least about 0.05, at least about 0.08, at least about 0.1.

Item 24. The coated abrasive article of any one of items 1, 2, and 3, wherein the backing comprises an air porosity value of at least about 0.1 seconds/100 cc according to the Standardized Air Porosity Test, wherein the backing comprises an air porosity value of at least about 0.5 seconds/100 cc, at least about 1 second/100 cc, at least about 2 seconds/100 cc, at least about 4 seconds/100 cc, at least about 7 seconds/100 cc, at least about 10 seconds/100 cc, at least about 12 seconds/100 cc, at least about 15 seconds/100 cc, at least about 20 seconds/100 cc, and not greater than about 100 seconds/100 cc, not greater than 90 seconds/100 cc, not greater than about 80 seconds/100 cc, not greater than about 60 seconds/100 cc, not greater than about 40 seconds/100 cc.

Item 25. The coated abrasive article of any one of items 1, 2, and 3, wherein the backing comprises a water absorption value of not greater than about according to the Cobb Test, wherein the backing comprises a water absorption value of not greater than about 60, not greater than about 55, not greater than about 50, not greater than about 45, not greater than about 40, not greater than about 35, not greater than about 30, and wherein the backing comprises a water absorption value of at least about 1, at least about 5, at least about 8.

Item 26. The coated abrasive article of any one of items 1 and 2, wherein the spunlace polyester-based material of the backing comprises a machine-direction shear modulus of not greater than about 100 MPa, not greater than about 90 MPa, not greater than about 80 MPa, not greater than about 70 MPa, wherein the spunlace polyester-based material of the backing comprises a machine-direction shear modulus of at least about 10 MPa, at least about 20 MPa, at least about 30 MPa, at least about 40 MPa.

Item 27. The coated abrasive article of any one of items 1 and 2, wherein the spunlace polyester-based material of the backing comprises a cross-direction shear modulus of not greater than about 15 MPa, not greater than about 12 MPa, not greater than about 10 MPa, not greater than about 9 MPa, wherein the spunlace polyester-based material of the backing comprises a cross-direction shear modulus of at least about 1 MPa, at least about 2 MPa, at least about 3 MPa, at least about 4 MPa.

Item 28. The coated abrasive article of item 3, wherein the non-woven material of the backing comprises a machine-direction shear modulus of not greater than about 100 MPa, not greater than about 90 MPa, not greater than about 80 MPa, not greater than about 70 MPa, wherein the spunlace polyester-based material of the backing comprises a machine-direction shear modulus of at least about 10 MPa, at least about 20 MPa, at least about 30 MPa, at least about 40 MPa.

Item 29. The coated abrasive article of item 3, wherein the non-woven material of the backing comprises a cross-direction shear modulus of not greater than about 15 MPa, not greater than about 12 MPa, not greater than about 10 MPa, not greater than about 9 MPa, wherein the spunlace polyester-based material of the backing comprises a cross-direction shear modulus of at least about 1 MPa, at least about 2 MPa, at least about 3 MPa, at least about 4 MPa.

Item 30. The coated abrasive article of any one of items 1 and 2, wherein the saturant extends substantially uniformly throughout an entire volume of the spunlace polyester-based material, wherein the saturant extends substantially uniformly throughout an entire thickness of the spunlace polyester-based material, wherein the saturant is substantially disposed within pores in the spunlace polyester-based material of the backing.

Item 31. The coated abrasive article of any one of items 1 and 2, wherein the saturant is non-uniformly disposed throughout an entire volume of the spunlace polyester-based material, wherein the saturant extends substantially non-uniformly throughout an entire thickness of the spunlace polyester-based material, wherein the saturant is preferentially disposed at a major surface of the spunlace polyester-based material, wherein a content of the saturant is different at a major surface of the spunlace polyester-based material as compared to an interior region spaced away from the major surface of the spunlace polyester-based material, wherein a content of the saturant is greater at a major surface of the spunlace polyester-based material as compared to an interior region spaced away from the major surface of the spunlace polyester-based material.

Item 32. The coated abrasive article of item 3, wherein the saturant extends substantially uniformly throughout an entire volume of the non-woven material, wherein the saturant extends substantially uniformly throughout an entire thickness of the non-woven material, wherein the saturant is substantially disposed within pores in the non-woven material of the backing.

Item 33. The coated abrasive article of item 3, wherein the saturant is non-uniformly disposed throughout an entire volume of the non-woven material, wherein the saturant extends substantially non-uniformly throughout an entire thickness of the non-woven material, wherein the saturant is preferentially disposed at a major surface of the non-woven material, wherein a content of the saturant is different at a major surface of the non-woven material as compared to an interior region spaced away from the major surface of the non-woven material, wherein a content of the saturant is greater at a major surface of the non-woven material as compared to an interior region spaced away from the major surface of the non-woven material, wherein the non-woven material comprises a spunlace material.

Item 34. The coated abrasive article of item 1, further comprising a frontfill overlying a major surface of the backing, wherein the frontfill is abutting a major surface of the backing, wherein the frontfill is bonded to the major surface of the backing, wherein the frontfill comprises phenolic resins, epoxy resins, urea resins, polyurethanes, polyamides, polyacrylates, polymethacrylates, polyvinyl chlorides, polyethylene, polysiloxane, silicones, cellulose acetates, nitrocellulose, natural rubber, starch, shellac, and a combination thereof.

Item 35. The coated abrasive article of any one of items 1, 2, and 3, further comprising a backfill overlying a major surface of the backing, wherein the backfill is abutting a major surface of the backing, wherein the backfill is bonded to the major surface of the backing, wherein the backfill comprises polyesters, phenolic resins, epoxy resins, urea resins, polyurethanes, polyamides, polyacrylates, polymethacrylates, polyvinyl chlorides, polyethylene, polysiloxane, silicones, cellulose acetates, nitrocellulose, natural rubber, starch, shellac, and a combination thereof, wherein the backfill consists essentially of low density polyethylene.

Item 36. The coated abrasive article of any one of items 1, 2, and 3, wherein the backing further comprises an additive chosen from the group comprising of catalysts, coupling agents, curants, anti-static agents, suspending agents, anti-loading agents, lubricants, wetting agents, dyes, fillers, viscosity modifiers, dispersants, defoamers, and grinding agents.

Item 37. The coated abrasive article of any one of items 1, 2, and 3, wherein the abrasive layer includes a coating layer overlying the backing, wherein the coating layer comprises at least one of a make coat, size coat, pre-size coat, supersize coat, and a combination thereof.

Item 38. The coated abrasive article of item 37, wherein the make coat overlies the backing, wherein the make coat is bonded directly to a portion of the backing, wherein at least one layer of material is disposed between the make coat and the backing.

Item 39. The coated abrasive article of item 38, wherein the make coat comprises an organic material, wherein the make coat comprises a polymeric material, wherein the make coat comprises a material selected from the group comprising of phenolic resins, acrylics, urea resins, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and a combination thereof.

Item 40. The coated abrasive article of item 37, wherein the coating layer comprises a size coat, wherein the size coat overlies a portion of the abrasive particles, wherein the size coat overlies a make coat, wherein the size coat is bonded directly to a portion of the abrasive particles.

Item 41. The coated abrasive article of item 40, wherein the size coat comprises an organic material, wherein the size coat comprises a polymeric material, wherein the size coat comprises a material selected from the group consisting of phenolic resins, acrylics, urea resins, epoxy resins, polyurethanes, polyamides, polyacrylates, polymethacrylates, polyvinyl chlorides, polyethylene, polysiloxane, silicones, cellulose acetates, nitrocellulose, natural rubber, starch, shellac, and a combination thereof.

Item 42. The coated abrasive article of any one of items 1, 2, and 3, wherein abrasive particles comprise a polycrystalline material, wherein the polycrystalline material comprises grains, wherein the abrasive particles are selected from the group of materials comprising of nitrides, oxides, carbides, borides, oxynitrides, superabrasives, and a combination thereof, wherein the abrasive particles comprise an oxide selected from the group of oxides comprising of aluminum oxide, zirconium oxide, titanium oxide, yttrium oxide, chromium oxide, strontium oxide, silicon oxide, and a combination thereof, wherein the abrasive particles comprise alumina.

Item 43. The coated abrasive article of any one of items 1, 2, and 3, wherein the abrasive particles comprise a seeded sol gel-based abrasive particle, wherein the abrasive particles comprise a polycrystalline material having an average grain size not greater than about 1 micron.

Item 44. The coated abrasive article of any one of items 1, 2, and 3, wherein the abrasive particles include shaped abrasive particles, wherein the abrasive particles include irregular-shaped abrasive particles.

Item 45. The coated abrasive article of any one of items 1 and 2, wherein the spunlace polyester-based material comprises a majority content of polyester by volume, wherein the spunlace polyester-based material comprises at least about 75 vol % polyester for a total volume of the spunlace polyester-based material, wherein the spunlace polyester-based material consists essentially of polyester.

Item 46. The coated abrasive article of item 3, wherein the non-woven material comprises a spunlace material, wherein the non-woven material comprises a spunlace polyester-based material including a majority content of polyester by volume, wherein the spunlace polyester-based material comprises at least about 75 vol % polyester for a total volume of the spunlace polyester-based material, wherein the spunlace polyester-based material consists essentially of polyester.

Item 47. The coated abrasive article of any one of items 1, 2, and 3, further comprising an intermediate layer, wherein the intermediate layer comprises at least one material selected from the group comprising of an inorganic material, an organic material, a polymer, cloth, paper, film, fabric, fleeced fabric, vulcanized fiber, woven material, non-woven material, webbing, polymer, resin, phenolic resin, phenolic-latex resin, epoxy resin, polyester resin, urea formaldehyde resin, polyester, polyurethane, polypropylene, polyimides, and a combination thereof, wherein the intermediate layer comprises a woven cotton material.

Item 48. The coated abrasive article of any one of items 1, 2, and 3, further comprising an open coat of the abrasive particles on the backing, wherein the open coat comprises a coating density of not greater than about 70 particles/cm2, not greater than about 65 particles/cm2, not greater than about 60 particles/cm2, not greater than about 55 particles/cm2, not greater than about 50 particles/cm2, at least about 5 particles/cm2, at least about 10 particles/cm2.

Item 49. The coated abrasive article of any one of items 1, 2, and 3, further comprising a closed coat of abrasive particles on the backing, wherein the closed coat comprises a coating density of at least about 75 particles/cm2, at least about 80 particles/cm2, at least about 85 particles/cm2, at least about 90 particles/cm2, at least about 100 particles/cm2.

Item 50. The coated abrasive article of any one of items 1, 2, and 3, wherein the body comprises a first set of perforations.

Item 51. The coated abrasive article of item 50, wherein the first set of perforations intersect a lower major surface of the backing and extend into a thickness of the backing.

Item 52. The coated abrasive article of item 50, wherein the first set of perforations have an average depth that is at least a portion of a thickness of the backing.

Item 53. The coated abrasive article of item 50, wherein the first set of perforations have an average depth that is at least a portion of a thickness of the body.

Item 54. The coated abrasive article of item 50, wherein the first set of perforations have an average depth that extends through an entire thickness of the backing.

Item 55. The coated abrasive article of item 50, wherein the first set of perforations have an average depth extending from a lower major surface of the backing and into the abrasive layer.

Item 56. The coated abrasive article of item 50, wherein the first set of perforations define a perforation axis extending laterally across the body.

Item 57. The coated abrasive article of item 50, wherein the first set of perforations extend along a substantially linear path.

Item 58. The coated abrasive article of item 50, wherein the first set of perforations extend along an arcuate path.

Item 59. The coated abrasive article of item 50, wherein the first set of perforations extend along an entire width of the backing.

Item 60. The coated abrasive article of item 50, further comprising a second set of perforations separate from the first set of perforations.

Item 61. The coated abrasive article of item 60, wherein the second set of perforations intersect a lower major surface of the backing and extend into a thickness of the backing.

Item 62. The coated abrasive article of item 60, wherein the second set of perforations are displaced from the first set of perforations along a longitudinal axis of the body.

Item 63. The coated abrasive article of item 60, wherein the second set of perforations have an average depth that is at least a portion of a thickness of the backing.

Item 64. The coated abrasive article of item 60, wherein the second set of perforations have an average depth that is at least a portion of a thickness of the body.

Item 65. The coated abrasive article of item 60, wherein the second set of perforations have an average depth that extends through an entire thickness of the backing.

Item 66. The coated abrasive article of item 60, wherein the second set of perforations have an average depth extending from a lower major surface of the backing and into the abrasive layer.

Item 67. The coated abrasive article of item 60, wherein the second set of perforations define a perforation axis extending laterally across the body.

Item 68. The coated abrasive article of item 60, wherein the second set of perforations extend along a substantially linear path.

Item 69. The coated abrasive article of item 60, wherein the second set of perforations extend along an arcuate path.

Item 70. The coated abrasive article of item 60, wherein the second set of perforations extend along an entire width of the backing.

Item 71. The coated abrasive article of item 60, further comprising a longitudinal distance between the first set of perforations and the second set of perforations.

Item 72. The coated abrasive article of item 60, wherein the coated abrasive article is contained within a dispenser.

Item 73. The coated abrasive article of item 60, wherein the coated abrasive article comprises a plurality of sets of perforations and is contained within a dispenser, and wherein the coated abrasive article is configured to be dispensed in a size-selective manner.

Item 74. A method of forming a coated abrasive article comprising: saturating a backing preform comprising a spunlace polyester-based material with a saturant to form a backing, wherein the saturant comprises a material selected from the group comprising of phenolic resin, acrylic, and a combination thereof; and forming an abrasive layer overlying the backing.

What is claimed is:

1. A coated abrasive article comprising:

a body including:

a backing including a spunlace polyester-based material and a saturant contained in the spunlace polyester-based material, wherein the saturant comprises a material selected from the group comprising of phenolic resin, acrylic, urea resin, and a combination thereof; and an abrasive layer overlying the backing including abrasive particles, wherein the backing comprises a saturant/backing content ratio (Cs/Cb) of at least about 0.01 and not greater than about 1.

2. The coated abrasive article of claim 1, wherein the spunlace polyester-based material has an areal density of at least about 50 grams per square meter (GSM) and not greater than about 300 grams per square meter (GSM).

3. The coated abrasive article of claim 1, wherein the spunlace polyester-based material has a machine-direction stiffness of at least about 80 MPa and not greater than about 220 MPa, and a cross-direction stiffness of at least about 1 MPa and not greater than about 40 MPa.

4. The coated abrasive article of claim 1, wherein the spunlace polyester-based material has an average thickness of at least about 0.05 mm and not greater than about 10 mm.

5. The coated abrasive article of claim 1, wherein the backing comprises an average thickness of at least about 0.05 mm and not greater than about 10 mm.

6. The coated abrasive article of claim 1, wherein the backing comprises a generally planar upper major surface, wherein the upper major surface comprises an average surface roughness (Ra) of at least about 1 micron and not greater than about 20 microns.

7. The coated abrasive article of claim 1, wherein the backing comprises a generally planar lower major surface, wherein the lower major surface comprises an average surface roughness (Ra) of at least about 5 microns and not greater than about 30 microns.

8. The coated abrasive article of claim 1, wherein the backing comprises a machine-direction stiffness of at least about 200 MPa and not greater than about 400 MPa.

9. The coated abrasive article of claim 1, wherein the backing comprises a cross-direction stiffness of at least about 1 MPa and not greater than about 50 MPa.

10. The coated abrasive article claim 1, wherein the spunlace polyester-based material comprises a porosity of at least about 1 vol % and not greater than about 25 vol % for a total volume of the backing.

11. The coated abrasive article of claim 1, wherein the backing comprises an air porosity value of at least about 0.1 seconds/100 cc according to the Standardized Air Porosity Test.

12. The coated abrasive article of claim 1, wherein the backing comprises a water absorption value according to the Cobb Test of at least about 1 and not greater than about 60.

13. The coated abrasive article of claim 1, wherein the spunlace polyester-based material of the backing comprises a machine-direction shear modulus of at least about 10 MPa and not greater than about 100 MPa.

14. The coated abrasive article of claim 1, wherein the spunlace polyester-based material of the backing comprises a cross-direction shear modulus of at least about 1 MPa and not greater than about 15 MPa.

15. The coated abrasive article claim 1, wherein the saturant extends substantially uniformly throughout the spunlace polyester-based material of the backing.

16. The coated abrasive article of claim 1, wherein the spunlace polyester-based material comprises a majority content of polyester by volume.

17. The coated abrasive article of claim 1, further comprising an intermediate layer comprising at least one material selected from the group comprising a polymer, cloth, paper, film, fabric, fleeced fabric, vulcanized fiber, woven material, non-woven material, webbing, phenolic resin, phenolic-latex resin, epoxy resin, polyester resin, urea formaldehyde resin, polyester, polyurethane, polypropylene, polyimides, and a combination thereof.

18. The coated abrasive article of claim 1, wherein the body comprises a first set of perforations.

19. A method of forming a coated abrasive article comprising:

saturating a backing preform comprising a spunlace polyester-based material with a saturant to form a backing, wherein the saturant comprises a material selected from the group comprising of phenolic resin, acrylic, and a combination thereof;

and forming an abrasive layer overlying the backing, wherein the backing comprises a saturant/backing content ratio (Cs/Cb) of at least about 0.01 and not greater than about 1.

* * * * *